US006155552A

United States Patent [19]

Hirai et al.

[11] Patent Number: 6,155,552

[45] **Date of Patent: *Dec. 5, 2000**

[54] SORTER AND IMAGE FORMING APPARATUS

[75] Inventors: Katsuaki Hirai; Noriyoshi Ueda, both of Yokohama; Shinichi Nakamura, Kawasaki; Yoshifumi Takehara, Yokohama; Chikara Sato, Hachiohji; Yuji Morishige, Yokohama; Kenji Kobayashi, Tokyo; Mitsushige Murata, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/803,100

[22] Filed: Feb. 20, 1997

Related U.S. Application Data

[63] Continuation of application No. 08/538,428, Oct. 2, 1995.

[30] Foreign Application Priority Data

Oct. 2, 1995 [JP] Japan ..... 6-237091

[51] Int. Cl.[7] ..... B65H 39/02

[52] U.S. Cl. ..... 270/58.16; 270/58.17; 270/58.19

[58] Field of Search ..... 270/58.14, 58.15, 270/58.16, 58.17, 58.19; 271/293

[56] References Cited

U.S. PATENT DOCUMENTS

| | | | |
|---|---|---|---|
| Re. 35,087 | 11/1995 | Uto et al. . | |
| 4,328,963 | 5/1982 | DuBois et al. . | |
| 4,332,377 | 6/1982 | DuBois et al. . | |
| 4,337,936 | 7/1982 | Lawrence . | |
| 4,343,463 | 8/1982 | Lawrence . | |
| 4,466,608 | 8/1984 | DuBois et al. . | |
| 4,928,941 | 5/1990 | Uto et al. . | |
| 4,962,920 | 10/1990 | Kitajima et al. | 271/293 |
| 5,112,035 | 5/1992 | Yamamoto et al. | 270/58.15 |
| 5,255,908 | 10/1993 | Hiroi et al. | 270/58.19 X |
| 5,282,611 | 2/1994 | Ueda et al. | 271/293 X |
| 5,382,016 | 1/1995 | Kobayashi et al. | 270/58.16 X |
| 5,417,417 | 5/1995 | Takehara et al. . | |
| 5,443,248 | 8/1995 | Hayashi et al. . | |
| 5,447,297 | 9/1995 | Murata et al. . | |
| 5,449,167 | 9/1995 | Takehara et al. . | |

FOREIGN PATENT DOCUMENTS

| | | | |
|---|---|---|---|
| 0355751 | 2/1990 | European Pat. Off. . | |
| 0522462 | 1/1993 | European Pat. Off. . | |
| 60-228357 | 11/1985 | Japan | 271/293 |

*Primary Examiner*—Hoang Nguyen
*Attorney, Agent, or Firm*—Fitzpatrick, Cella, Harper & Scinto

[57] ABSTRACT

A sheet sorting apparatus includes a plurality of trays for accommodating sheets; a helical cam device, engageable with a cam follower for moving the plurality of trays; a cam driving device for driving the helical cam device; a sheet set processing device movable between processing position and a retracted position where the processing device doe snot interfere with the plurality of trays; a reversible driving device for advancing or retracting the sheet set processing device; and a controlling device for controlling the driving device; wherein a cam surface of the helical cam is constituted of substantially horizontal portions and slanted portions; and the cam driving device and the driving device are controlled by the controlling device, in such a manner that the sheet set processing device starts to enter a processing position when the cam follower shifts from the slanted portions to the horizontal portions, and the entering operation ends by the time the cam follower reaches the middle portion of the horizontal portion, and that the cam driving device is deactivated when the cam follower is substantially at a middle portion of the horizontal portions, and after sheet set processing, the cam driving device and the driving device are actuated, and the sheet set processing device is retracted from a moving path region of the tray by the time the cam follower passes through the remaining portion of the horizontal portions.

35 Claims, 26 Drawing Sheets

SORTER AND IMAGE FORMING APPARATUS

This application is a continuation of application Ser. No. 08/538,428 filed Oct. 2, 1995.

FIELD OF THE INVENTION AND RELATED ART

The present invention relates to a sorting apparatus comprising processing means for carrying out a process such as binding. More specifically, it relates to a sheet sorting apparatus for accumulating and/or sorting the sheets discharged from an image forming apparatus or the like.

Generally speaking, this type of sorter comprises approximately ten to twenty (sometimes more) sheet accumulator trays (hereinafter, bins) which are vertically arranged at predetermined intervals. In this type of sorter, the sheets, which are sequentially discharged, at predetermined intervals, from an image forming apparatus, are sequentially conveyed and deposited into designated bins by conveying means constituted of a belt or belts, a plurality of rollers, or a combination of belts and rollers.

The sorters of this type can be subdivided into the following two groups: a moving bin type sorter group, in which the bins for accumulating the sheets are moved to pass in front of the discharge opening of a designated sheet conveying path, and a fixed bin type sorter group, in which a discharging unit is moved to deliver the sheets to the fixedly arranged bins, or the sheets conveyed through a designated main path are further delivered to designated bins by the function of a flapper (directing means).

At this time, the structure of a well-known, conventional sorter of the moving bin type will be concisely described. As has been known, in the conventional sorter of the moving bin type, each bin is moved in such a manner that the entrance to the bin is widened as the bin arrives at a point where the sheets are deposited into the bin. As for the means employed in the apparatuses of the aforementioned type, there are means disclosed in U.S. Pat. Nos. 4,328,963, 4,343,463, 4,466,608, 4,337,936, and 4,332,377, for example.

In these apparatuses, a pair of trunnions, which are individually mounted on the entrance side of each bin, are engaged with an interval expanding mechanism constituted of a rotative Geneva or a lead cam, so that the bin intervals are sequentially widened at the sheet deposition point, as the bins are vertically moved up or down.

FIGS. 24 and 25 are side views of the essential portion of a sheet sorting apparatus of the aforementioned type. This portion comprises: a pair of guide rails (right and left guide rails) 152; trunnion pairs 151*a,* 151*b* and 151*c* (hereinafter, bin rollers), which are mounted on bins Ba, Bb, and Bc, at the corresponding lateral edges, and are moved up or down, being guided by the pair of guide rails 152; and a pair of lead cams (right and left cams) 153*a* and 153*b*. The end portion of the bin roller is engageable with the grooved cam surface of the lead cam. As the lead cams 153*a* and 153*b* are rotated in the directions of arrow marks A and D, or in reverse, respectively, the bin rollers are moved up or down. When the bin rollers 151*a* and 151*b* ride on the lead cams 153*a* and 153*b,* respectively, as illustrated in the drawings, the intervals between the bins Ba and Bb, and between the bins Bb and Bc, are locally expanded so that the sheet can be easily deposited into the bins by the discharge roller pair of the main assembly. After the sheet deposition, the bins Ba, Bb, Bc, and so on, are sequentially moved up or down, restoring the original intervals.

In other words, the bin unit is efficiently moved up or down (a single rotation of the lead cams 15*a* and 153*b* moves the bin unit a distance equivalent to the diameter of the bin roller), by means of supporting the weight of all bins (weight of the bin unit) by the upper surfaces of the lead cams 153*a* and 153*b;* therefore, necessary functions can be provided using the simple mechanical structure.

Next, the profile of the cam surface will be described referring to the cam surface development in FIG. 26.

The position of 0° is the home position. The sheet is deposited when the trunnion, in engagement with the cam, is at this home position. This portion of the cam surface is rendered level to tolerate any irregularity in cam rotation angle.

Recently, sorters with postsorting processing capabilities (stapling sorter), which are capable of performing additional processes (for example, stapling), have been devised.

Next, a stapling sorter will be described.

A stapler is advanced into the space created as the bin interval is expanded by the aforementioned expanding mechanism. A portion of the bin is cut away to accommodate the stapler, so that the sheets in the bin can be held and stapled by the stapler.

The stapler movement will be described with reference to the upward and downward movements of the bins. As a stapling instruction is given from an unillustrated control system, an oscillating motor for advancing or retracting the stapler is turned on. After being rotated a predetermined number of times to move the stapler to the binding position indicated by a solid line, the motor is turned off. After stapling, the motor is turned on again to be rotated a predetermined number of times to retract the stapler, and after retracting the stapler, it is turned off. At the same time, a shift motor for rotatively driving the lead cams is turned on, being rotated a predetermined number of times to lift the next bin to the stapling position. Thereafter, it is turned off. The preceding operations are repeated until the sheets in all bins are subjected to the postsorting process.

Generally, in order to increase the postsorting processing speed, that is, in order to shorten the stapler moving time or bin shifting time, the powers of the aforementioned cam oscillating motor or bin shifting motor have been increased.

However, in the above structure, it is necessary to move a large mass at a high speed or to stop it abruptly, requiring an increase in positive or negative acceleration. Therefore, operating noises become louder.

Further, there is a drawback in that the aforementioned demand for increased power results an increase in the apparatus size, which in turn results in cost increase.

SUMMARY OF THE INVENTION

The present invention was made in view of the conventional sorting apparatus described above. Its primary object is to provide a small, inexpensive and quiet sheet sorting apparatus capable of increasing the processing speed without increasing the bin shifting speed.

According to an aspect of the present invention, a sheet sorting apparatus with a sheet processing means comprises: a plurality of trays for storing sheets; spiral cam means for moving said plurality of trays, being engaged with a trunnion; cam driving means for rotatively driving said spiral cam means; sheet set processing means movable between a processing position and a retracting position; driving means for advancing or retracting said sheet set processing means; and controlling means for controlling said processing means driving means. The cam surface of said spiral cam is constituted of substantially level portions and slanted portions; and both of said cam driving means and processing means driving means are activated at least within the time frame in which the trunnion is engaged with the level portion of the cam surface. The sheet processing means advances to, or retracts from, the tray, without interfering with the tray, while the trunnion is on the slanted portion of the cam surface.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Figure 1:
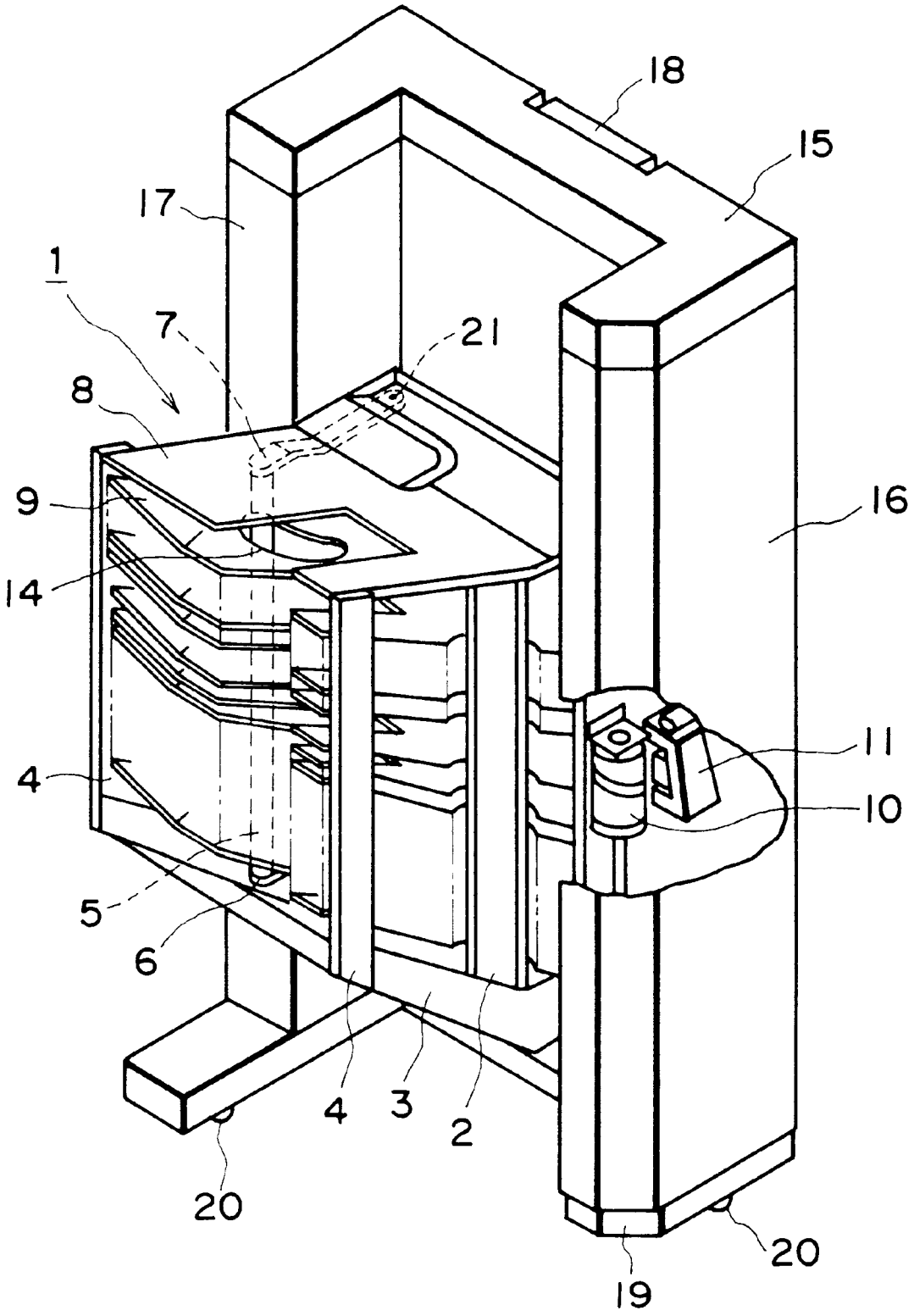
FIG. 1 is a perspective view of an embodiment of the sorter in accordance with the present invention.

FIGS. 1–5 illustrate the embodiments of the present invention.

In these drawings, a reference numeral 1 designates a bin unit containing a plurality of trays (bins or bin trays); 2, an alignment reference member erected between the frame 3 of the bin unit 1, and a top cover 8; 4, a structural member of the bin unit 1, which is disposed in front and back to support a bin 9, at the corresponding lateral ends; 5 designates an aligning rod disposed in such a manner as to penetrate all the bins, through voids 14 which are created by cutting a portion of each bin.

Reference numerals 6 and 7 designate arms which support the bottom and top ends of the aligning rod 5, respectively, and share the same rotational axis 22; 10, a lead cam for vertically moving the bin unit 1 (unillustrated lead cam identical to the lead cam 10 is disposed at the rear); 11, a stapler unit; 15, 16 and 17, covers; 18, a handle; 19, a bottom plate; and 20 designates a caster.

Figure 2:
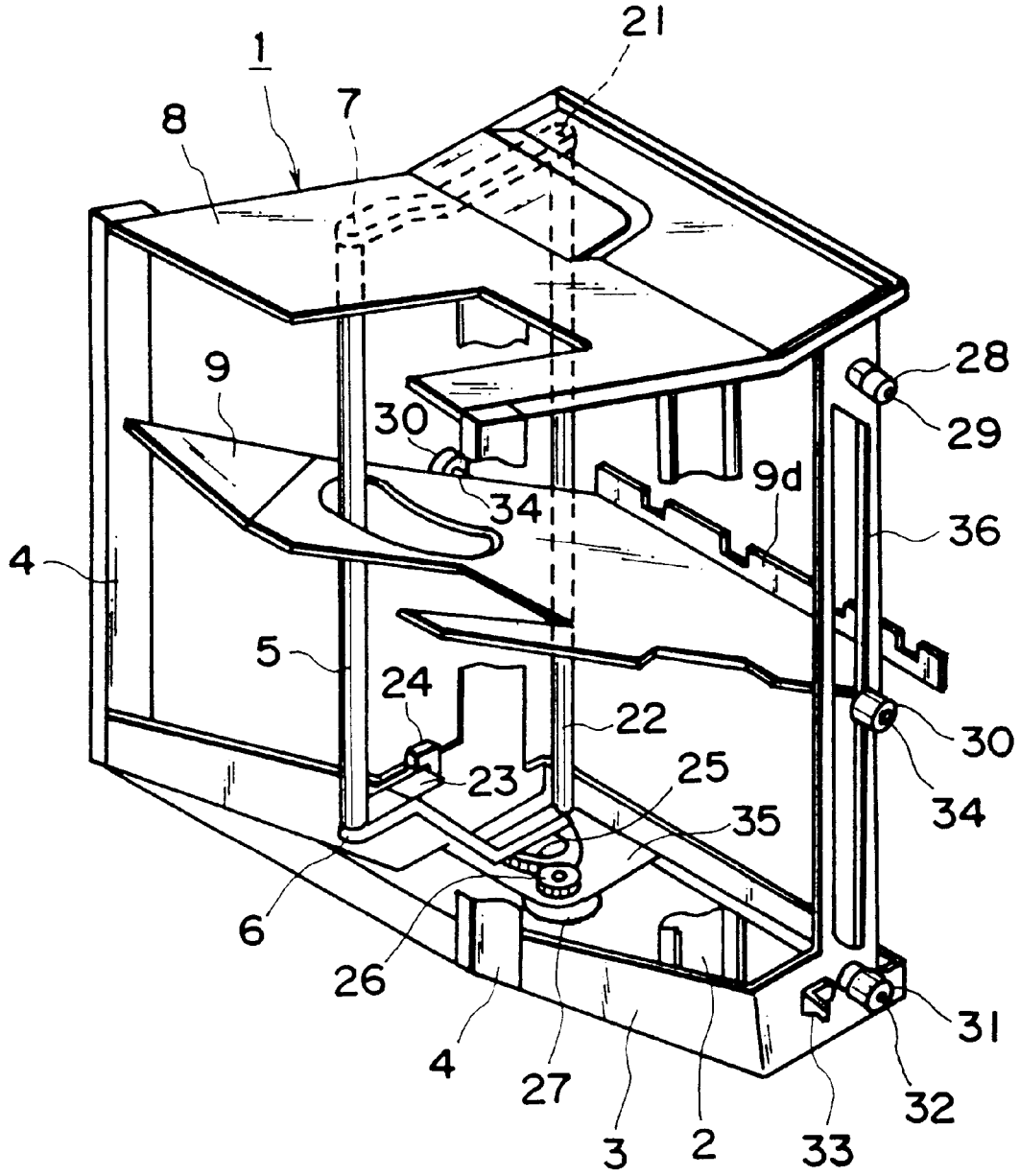
FIG. 2 is a perspective view of the bin unit of the sorter.

FIG. 2 depicts the detailed structure of the bin unit. In the drawing, a reference numeral 22 designates one of the pivots of the aligning rod, which serve as the rotational axis of the aligning rod 5. The top and bottom ends of the aligning rod 5 are fixed to the arms 7 and 6, at one end, respectively. The other ends of the arms 7 and 6 are pivoted on the top cover and a supporting plate 35 of an arm driving section, at the pivot 21 and an unillustrated pivot, respectively. Reference numerals 23 and 24 designate a sensor plate fixed on the arm 6, and a sensor fixed on the frame 3, respectively. The sensors 23 and 24 define the home position of the aligning rod 5. A reference numeral 25 designates a sector gear, which is fixed to the arm 6, and is engaged with the output shaft gear 26 of a motor 27 disposed on the supporting plate 35. The rotational axis of the sector gear 25 coincides with the rotational axis 22. Reference numerals 28 and 31 designate rollers mounted rotatively on shafts 29 and 32, respectively. The shafts 29 and 32 are fixed to the frame 3. A reference numeral 30 designates a roller (trunnion or cam follower), which are rotatively mounted on the supporting shaft 34 of the bin 9, and 33 designates a hook for anchoring a spring. The hook 33 is also fixed to the frame 3.

Figure 3:
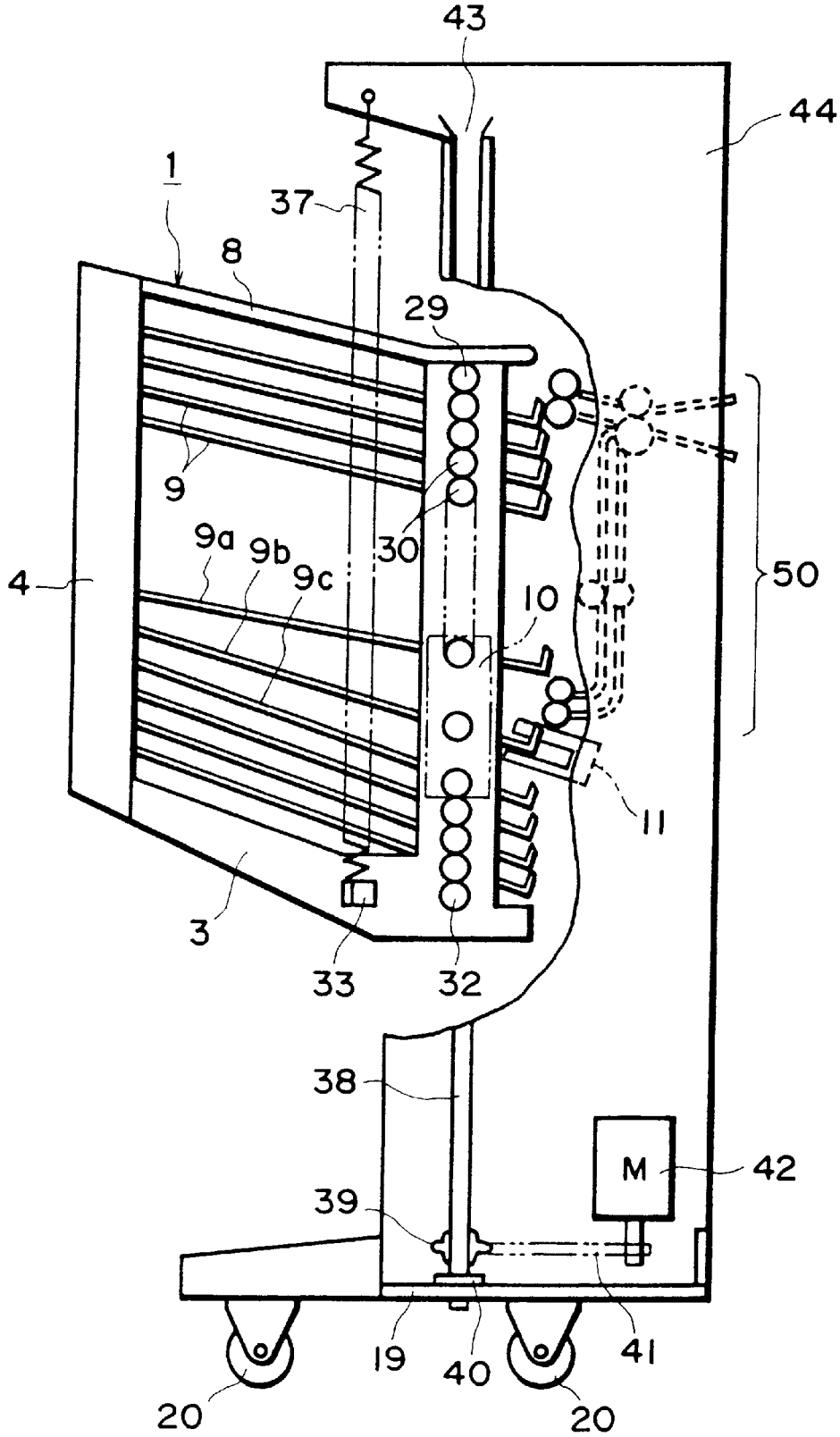
FIG. 3 is a partial cutaway front view of the sorter.
Figure 4:
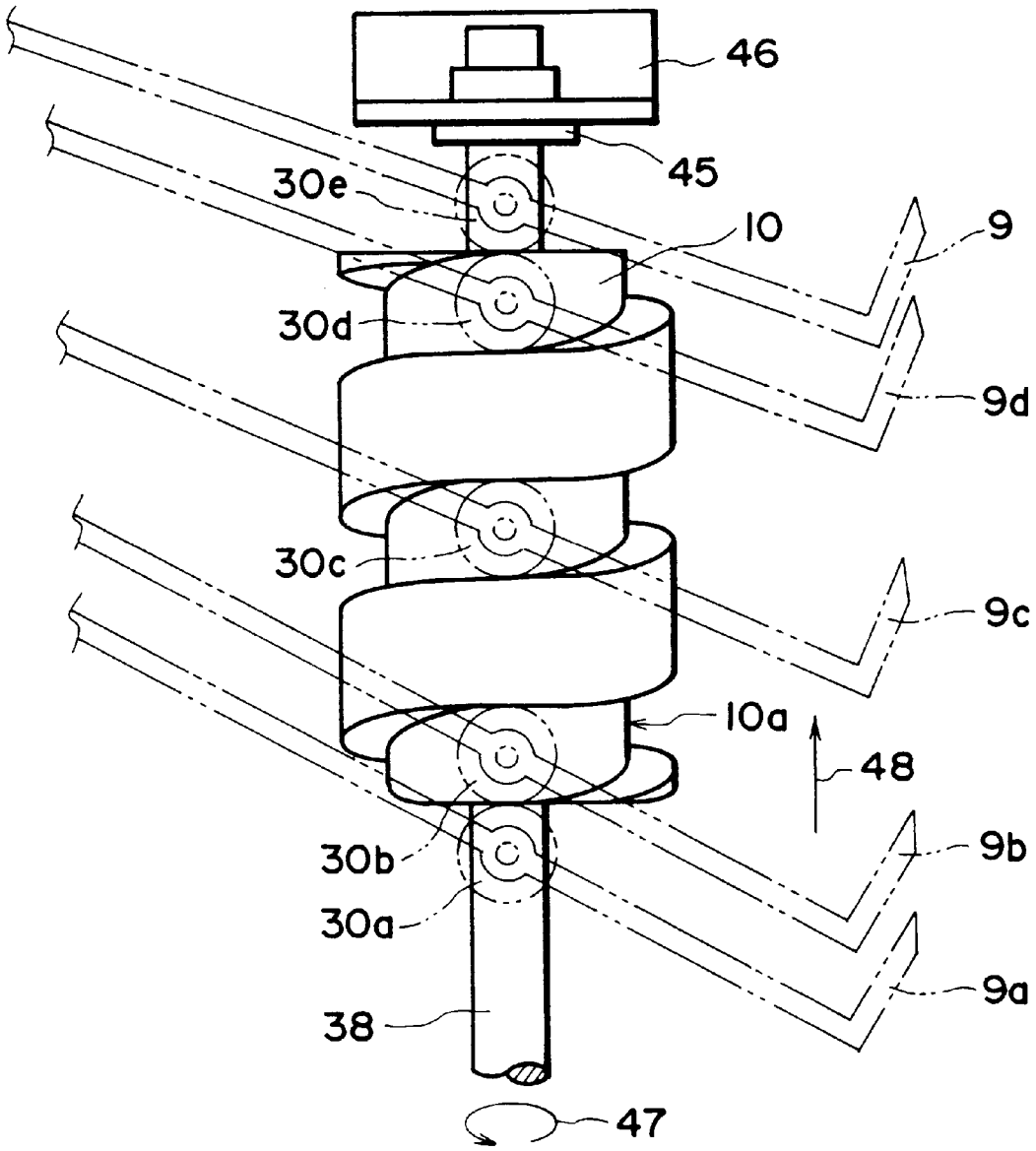
FIG. 4 is an enlarged front view of the lead cam of the sorter.

In FIG. 3, a reference numeral 37 designates a spring for countering the weight of the bin unit 1. There are a pair of springs 37, one being stretched in front, and the other (unillustrated) being stretched in back.

A reference numeral 38 designates the rotating shaft of the lead cam 10. One end of the rotating shaft 38 is fixed to the lead cam 10 with the use of a locking means, and the other end is fitted in a bearing 40 which bears the thrust load. The rotating shaft 38 is rotated by a bin shifting motor 42 (hereinafter, shift motor) through a belt or chain stretched between a toothed pulley 39 mounted on the rotating shaft 38 and the bin shifting motor 42. A reference numeral 50 designates a sheet conveying section. A main frame 44 is provided with a pair of grooves 43 which serve as a guide for the rollers 29, 30 and 32 of the bin unit 1, and therefore, the bin unit 1 is vertically movable along the grooves 43. A bin 9*a* is the bin immediately above the bin 9*b* which receives the sheet from the sheet discharge opening, and a bin 9*c* is the bin immediately below the bin 9*b*. The intervals between the bins 9*a* and 9*b*, and between the bins 9*b* and 9*c*, are expanded relative to the rest of the intervals between the adjacent two bins. The state of the expansion is depicted in detail in FIG. 4. In the drawing, a reference numeral 45 is a bearing for accommodating the top end of the rotating shaft 38, and 46 designates a supporting plate for supporting the bearing 45. The peripheral surface of the lead cam 10 has a groove 10*a*. The characteristic of the cam 10 given by the groove 10*a* is such that a first rotation of the lead cam 10 moves the roller from one end of the groove 10*a* to the vertical mid point of the groove 10*a,* and a second rotation of the lead cam 10 moves the roller to the other end of the groove 10*a*. In other words, as the lead cam 10 rotates once in the direction of an arrow mark 47, the roller 30*b* of the bin 9*c* rises in the direction of an arrow mark 48 along the groove 10*a* to a position 30*c*, and as the lead cam 10 rotates once more, the roller 30*b* moves to a position 30*d*. Therefore, the intervals between the bin 9*a* with the roller 30*a* and the bin 9*b* with the roller 30*b,* and between the bin 9*b* with the roller 30*b* and the bin 9*c* with the roller 9*c,* can be rendered wider than the rest of the intervals between the adjacent two bins (the roller of one bin is in contact with the roller of the other bin). It is needless to say that the bins come down as the lead cam 10 is rotated in the reverse direction of the arrow mark 7.

Figure 5:
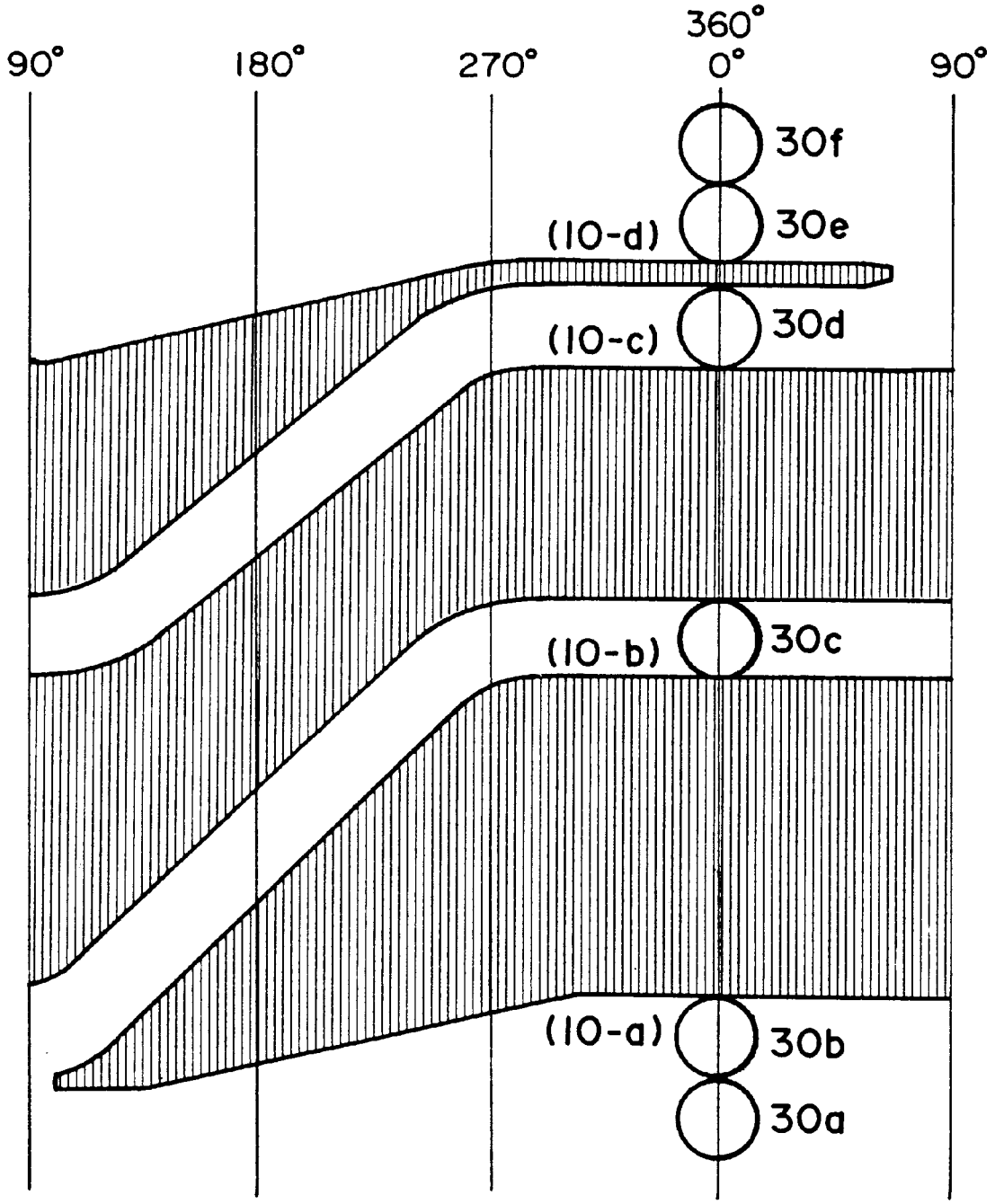
FIG. 5 is an enlarged development of the lead cam.

Next, the characteristic of the lead cam 10 will be described in further detail. FIG. 5 is a development of the lead cam 10. The cam angle is plotted on the X axis, and the height is plotted on the Y axis. The cam surface is constituted of a surface 1 (10-a), a surface 2 (10-b), a surface 3 (10-c), and a surface 4 (10-d), which are smoothly continuous.

To describe each cam surface, the surface 1 (10-a) regulates the bin rollers (30*a* and 30*b*) below the lead cam. It is gently slanted, that is, substantially level, so that when the lead cam 10 rotates, the bins below the lead cam are prevented from being rapidly moved up or down. The surfaces 2 (10-b) and 3 (10-c) are slanted between a position 90° and a position 270°, at an angle proportional to the wider bin interval, and are rendered substantially level across the remaining 180° to hold the bin rollers (30*c* and 30*d*) at predetermined heights, respectively. The surface 4 (10-d) regulates the bin rollers (30*e* and 30*f*) above the lead cam. It is gently slanted, that is, rendered substantially level, as is the surface 1 (10-a), so that the rapid vertical movement of the bin can prevented.

When the cam is given the characteristic described above, the movement of the bin unit movement, and the movement of the bin in the bin unit, are as follows. The bin unit is gradually moved up or down by the rotation of the lead cam. As the bin unit is moved up or down, the bin rollers come in contact with the lead cam. While the bin rollers are in contact with the lead cam, the bins are swiftly moved up or down when the cam angle is between 90° and 270°, and are held substantially stationary across the remaining 180°.

Referring to FIG. 5, the position 0° is correspondent to the home position of the lead cam, which is the point where the engagement between the lead cam and the bin rollers begins. When the stapling operation begins from the first bin after the completion of sheet discharge, the bin rollers stand by at the height indicated in the drawing.

Figure 6:
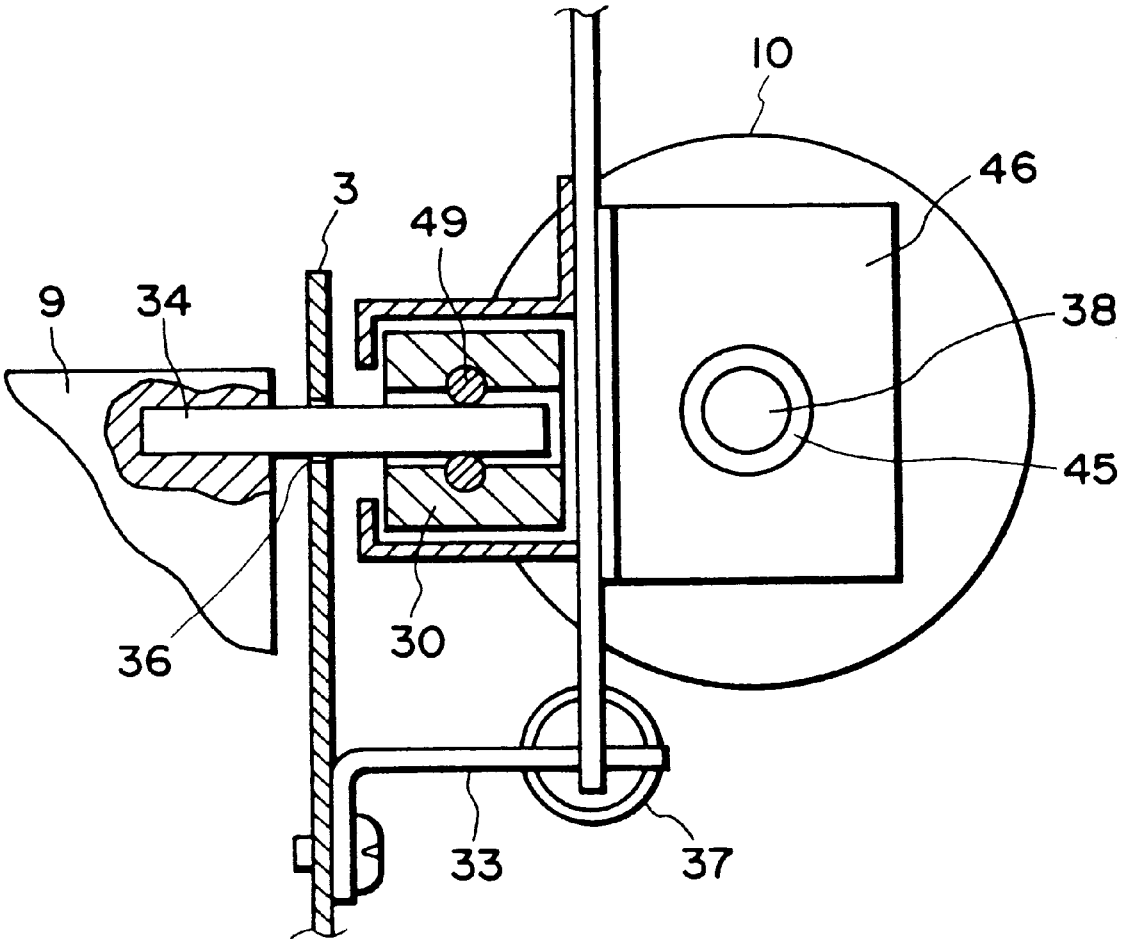
FIG. 6 is a horizontal sectional view of the lead cam and a roller, which are engaged.

FIG. 6 is a top plan view of the lead cam 10 and roller 30, which are engaged.

In the drawing, a reference numeral 49 designates an O-ring having been compressed into the roller 30. It absorbs the vibration generated when the bins are moved up or down.

Figure 7:
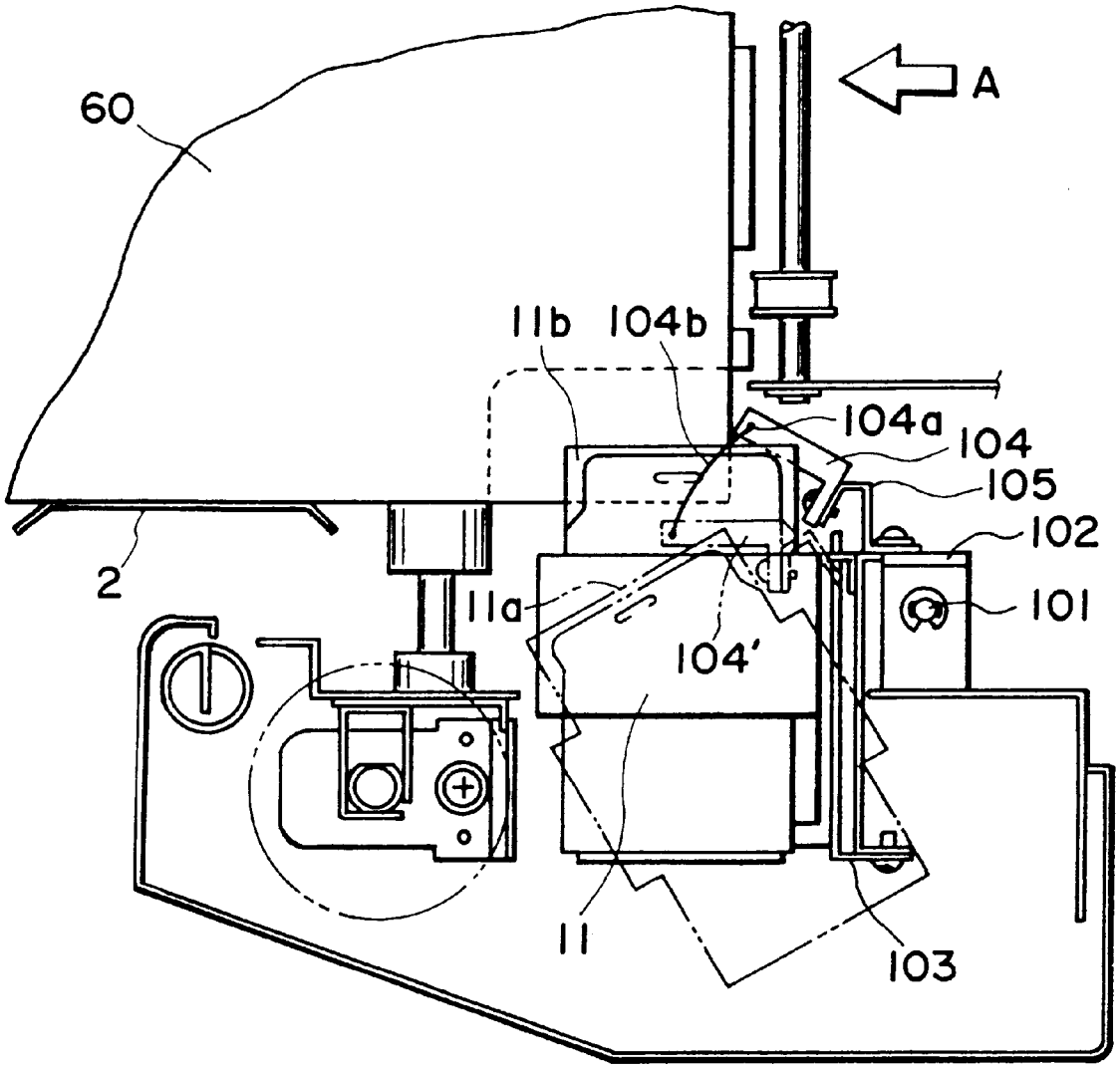
FIG. 7 is a plan view of the stapler oscillating section.

FIG. 7 is a top plan view of the stapling section. A reference numeral 11 designates the aforementioned stapler unit. Normally, it is positioned at a retracting position 11*a* (indicated with a double-dot chain line) when the sheet is discharged in the sheet delivery direction (direction A in the drawing). When the stapler unit is at this position, it is outside the sheet aligning area and the area through which the bins are vertically shifted. A reference numeral 11*b* designates a stapling position, that is, the position where the stapler unit 11 reaches as it is oscillated about a rotational axis 101 by a link unit which will be described later.

Figure 11:
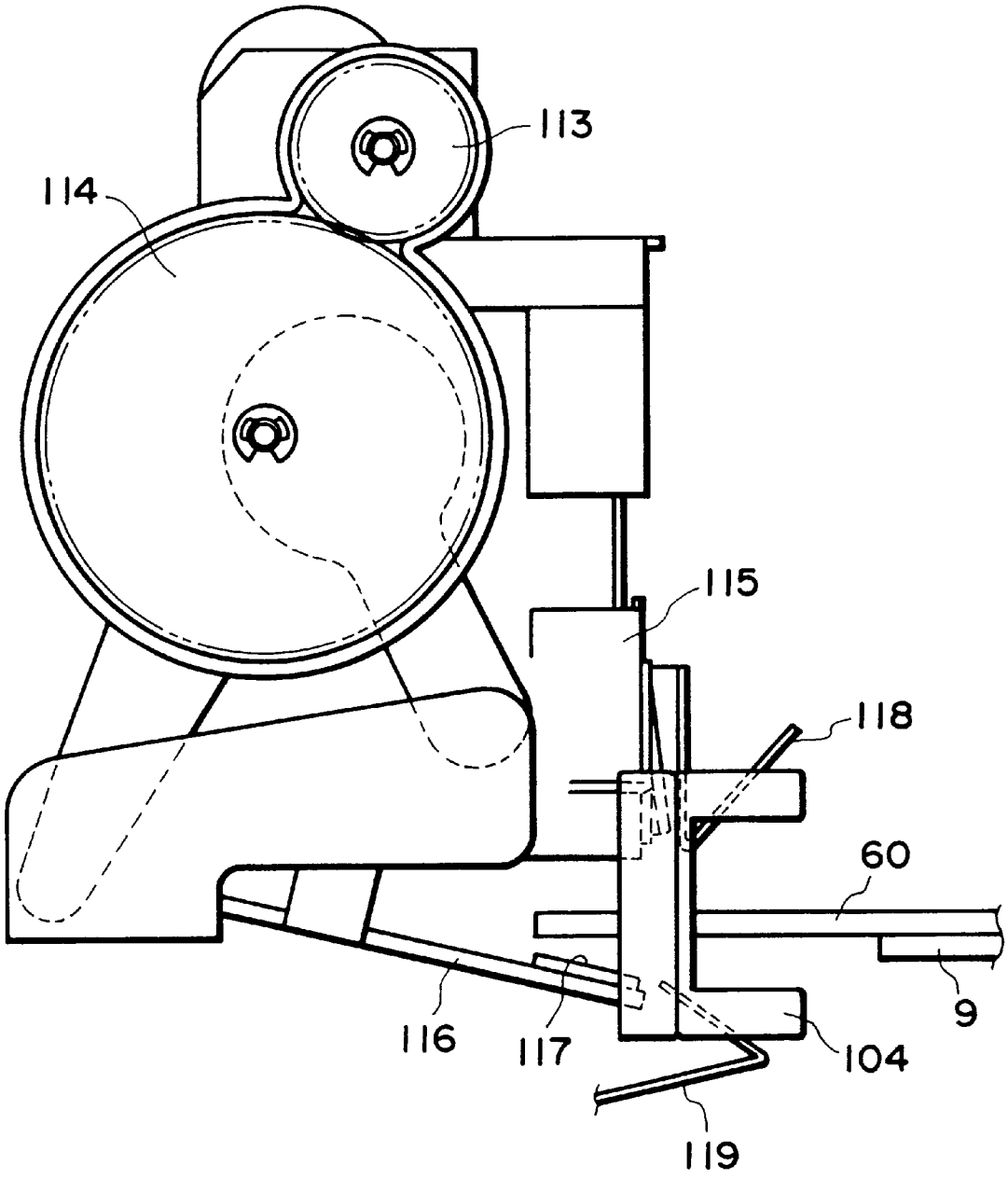
FIG. 11 is a front view of the stapler of the stapling section.

A reference numeral 102 designates an oscillating base plate. A stapler base plate 103 for supporting the stapler unit 11 is fixedly positioned on the oscillating base plate 102. The rotational axis of the oscillating base plate 102 coincides with the rotational axis 101. A reference numeral 104 designates a sheet sensor. In the embodiments of the present invention, the sheet sensor 104 is constituted of a transmission type sensor, being U-shaped as shown in FIG. 11, and detects the presence of the sheet by means of sweeping the sheet path in a manner of straddling over the sheet. A reference numeral 104*a* designates a sheet sensing position, and the sensing element of the sheet sensor 104 is contained at this position 104*a*. In the embodiments of the present invention, the transmission type sensor is listed as one of the most preferable sensors, but similar results can be obtained using a reflection type sensor. Further, sheet sensing means can be constructed using a reed switch of an actuator type, as long as the sheets on the bins are firmly held down by sheet holding means. A reference numeral 105 designates a sensor mounting base, which is fixed to the oscillating base plate 102 with the use of small screws. A reference numeral 104*b* designates the locus drawn by the sensing element when the oscillating base plate 102 is oscillated. It cuts across the corner of a sheet 60 on the bin. In this embodiment, when the stapler unit 11 is moved from the position 11*a* to the position 11*b,* the sensing element portion 104*a* of the sensor moves past the sheet, but the sensing element portion 104*a* may be allowed to continue sensing the sheet even when the stapler unit 11 is at the position 11*b* (the sensing element remains over the sheet even when the stapler unit 11 is at the stapling position). The latter arrangement is possible with the use of electrical control and the placement of a mechanical sensor.

A reference numeral 104' designates the position of the sheet sensor 104 when the stapler unit 11 is at the retracting position 11*a*. When the sheet sensor 104 is at this position 104', the sensor 104 also is outside the sheet aligning area as is the stapler unit 11.

Figure 8:
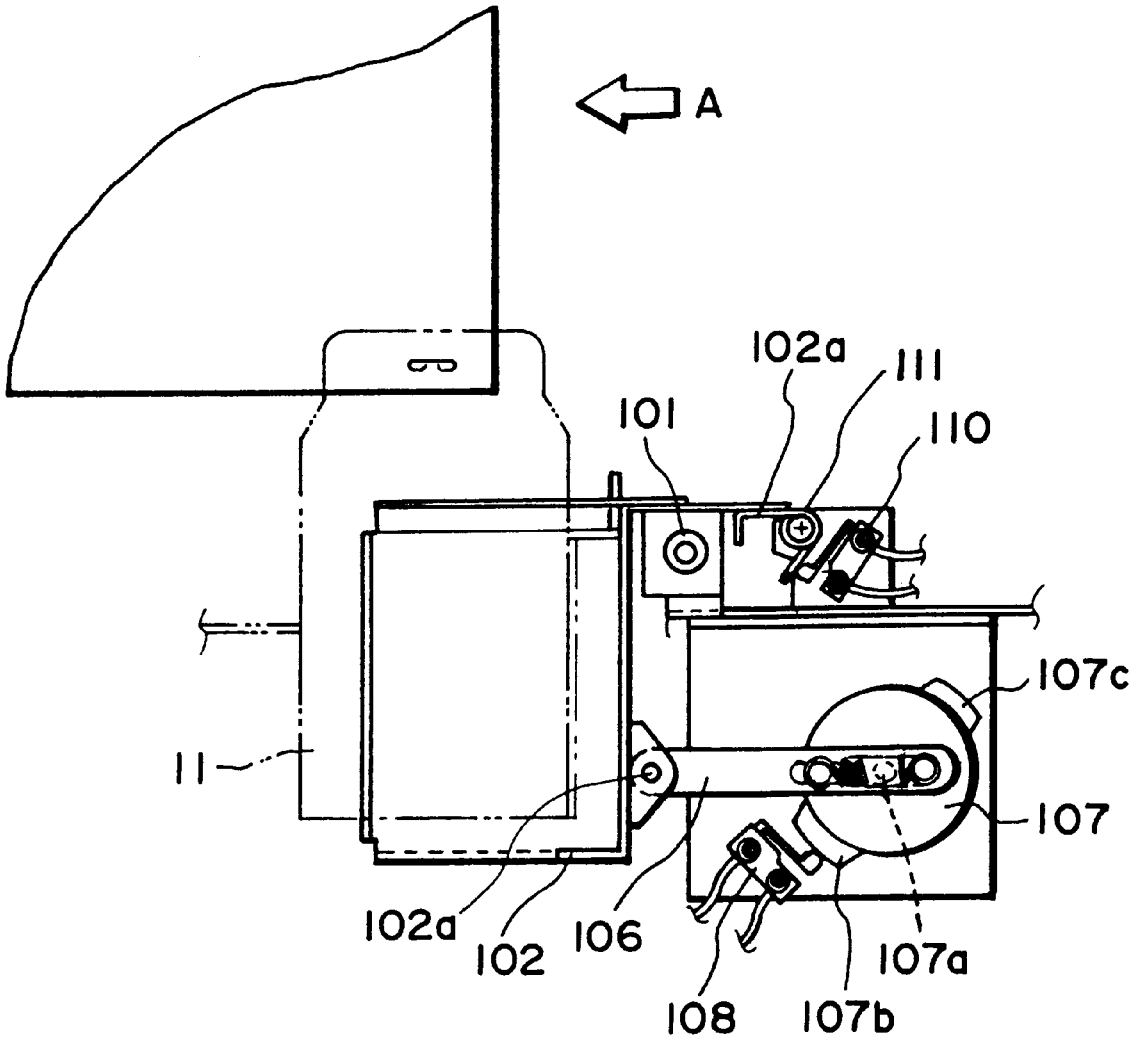
FIG. 8 is a detailed plan view of the oscillating section.

FIG. 8 is a top plan view of the oscillating mechanism of the stapler unit. It was previously stated that the stapler base plate 103 for supporting the stapler unit 11 could be removably disposed on the oscillating base plate 102. A reference numeral 102*a* designates the contact portion of the oscillating base plate 102. It is rotatively supported by a link arm 106.

Figure 9:
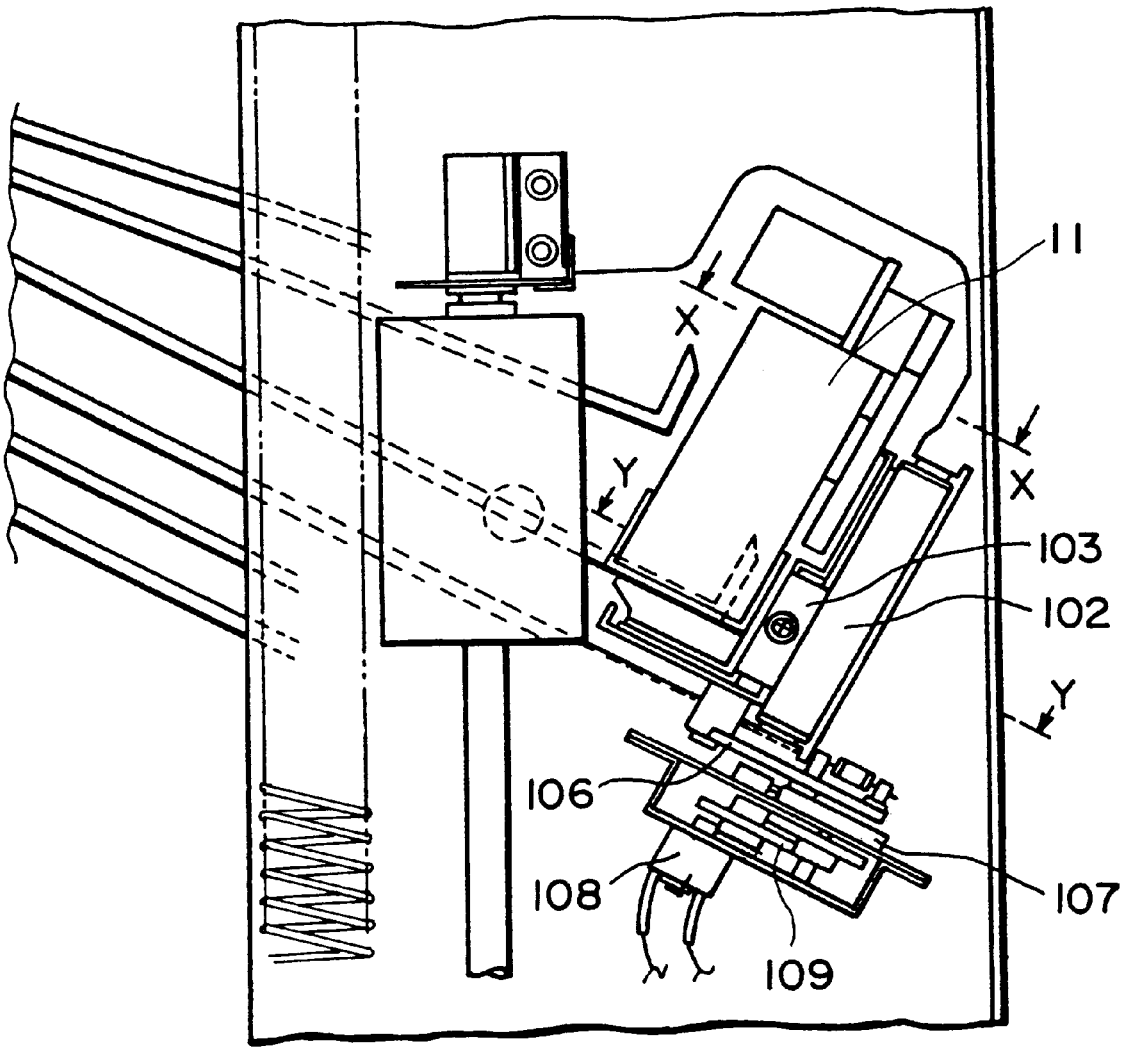
FIG. 9 is a sectional view of the stapler of the stapling section.

FIG. 9 is a front view of the driving unit for the stapler unit. The stapler unit driving unit will be described referring to both FIGS. 8 and 9.

A reference numeral 107 designates a link disk with a rotational center 107*a*. The link disk 107 receives the driving force from a motor 108 illustrated in FIG. 9, by way of a speed reduction unit constituted of gears. On the peripheral surface of the link disk 107, two cam-like portions (107*b* and 107*c*) are formed in a manner of opposing across the link disk 107, and are used to detect the cam angle by a position detecting microswitch 108. More specifically, the position detecting microswitch 108 detects whether the stapler 11 is at the stapling position 11*b* or retracting position 11*a*.

In FIG. 8, a point designated by a reference numeral 107 corresponds to the stapling position 11*b*.

A reference numeral 110 designates a microswitch for detecting the stapling position. The end portion 102*b* (contact portion) of the oscillating base plate 102, which oscillates together with the stapler unit, is formed of resin or the like material. As one end of an actuator 111 is pressed by the end portion 102*b*, the other end of the actuator 111 makes contact with the microswitch 110, whereby it is recognized that the stapler unit 11 is at the stapling position 11*b*. In other words, it is recognized by the position detecting microswitches 110 and 108 whether the stapler unit 11 is at the stapling position 11*b* or retracting position 11*b*, respectively.

As the stapler unit oscillating motor 103 keeps on rotating in the same direction, the stapler unit advances or retracts; as the link disk 107 rotates a first half revolution, the stapler unit advances, and as the disk 107 rotates a second half revolution, the stapler unit retracts. As for the positional relation between the stapler unit and bins, the oscillation angle is set up so that as the link disk 107 rotates a quarter of a revolution from the advanced position, a non-interfering relation is created, and as the link disk 107 rotates a quarter of a revolution, an interfering relation occurs.

Figure 10:
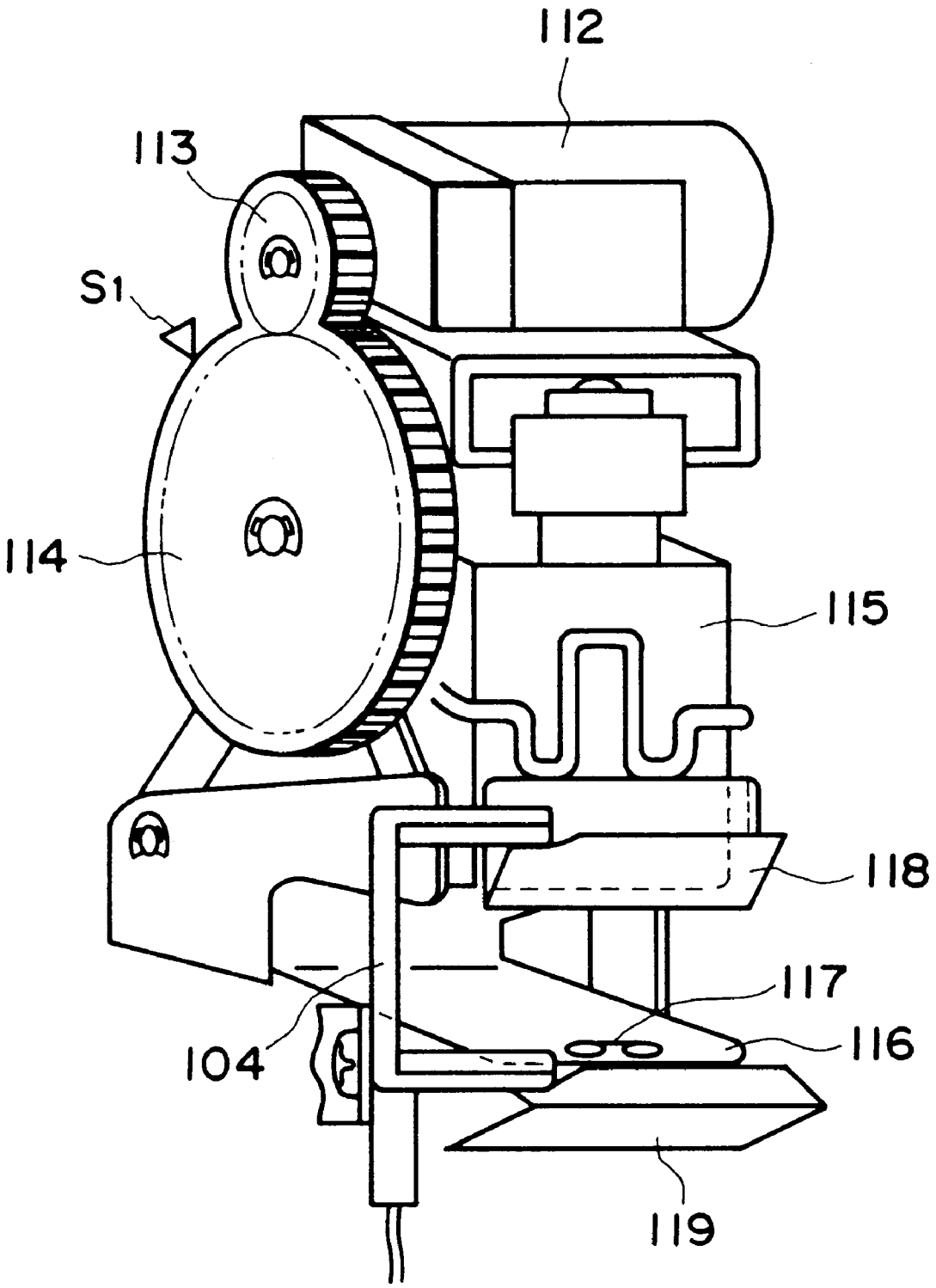
FIG. 10 is a perspective view of the stapler of the stapling section.

FIG. 10 depicts the structure of the stapler in accordance with the present invention.

To describe it briefly, the driving force from the stapler driving motor 112 is transmitted to gears 113 and 114. As the gear 114 rotates, the link unit directly connected to the gear 114 is rotated, causing the top and bottom units 115 and 116 to close in toward each other, bending the staple.

The staple is actually bent by an anvil designated by a reference numeral 117 in FIG. 10. FIG. 11 is a side view of the stapler. The anvil 117 in FIG. 11 is between the top and bottom units 115 and 116. Therefore, the sheet set 60 to be bound must be between the units 115 and 116. In this embodiment, the stapler is oscillated so that the anvil 117 is positioned at the corner portion of the sheet set 60, which has been aligned and properly positioned.

Next, the operation of the sorter in accordance with the present invention will be described.

The description of the sorting operation for sorting the sheets discharged from an image forming apparatus into the designated bins is exactly the same as the one for the conventional sorter; therefore, it will be omitted. In other words, steps for aligning and stapling the sheets after they are discharged into the bins will be sequentially described.

Figure 12:
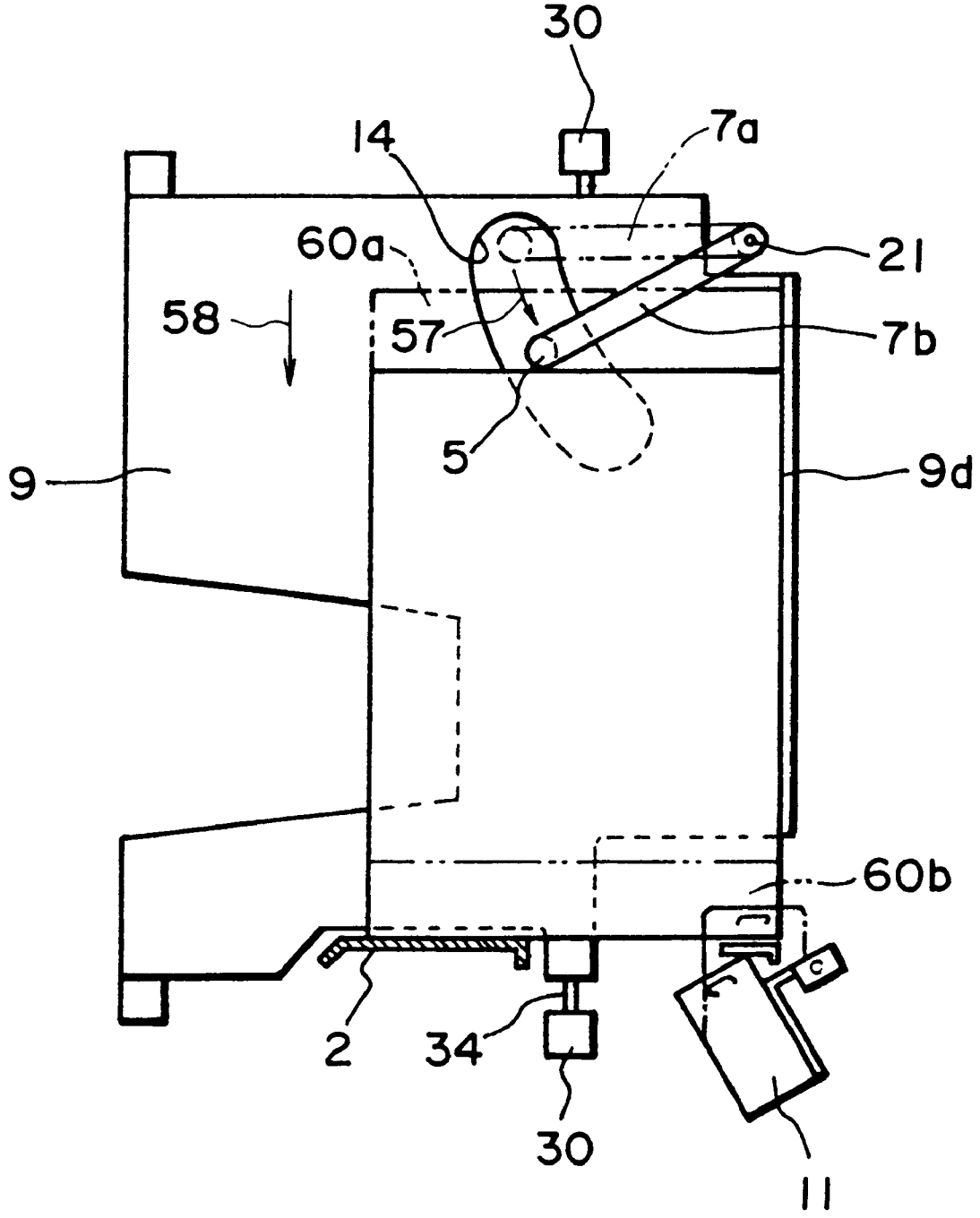
FIG. 12 is a plan view of the sorter.

Referring to FIG. 12, immediately after the sheet 60*a* is discharged into one of the bins, the arm 7*a*, having been parked at the standby position, is rotated in the direction of an arrow 57 about the rotational axis 21. As a result, the sheet 60*a* is pushed by the aligning rod 5, being thereby moved in the direction of an arrow 58. As for the aligning rod driving motor 27, a pulse motor, for example, is employed. As a pulse signal selected to match the sheet size is inputted to the motor 27, the sheet is moved until it strikes the alignment reference member 2; it is moved to a position 60*b* where it strikes the alignment reference member 2. Since the bin 9 is slanted downward toward the sheet discharging side, the discharged sheet keeps on moving due to its own weight until it strikes the stopper 9*b* disposed at the rear end of the bin. Thereafter, it is movable in the direction of the arrow 57 along the stopper 9*d*. The arm 7*b* returns to the standby position 7*a* to prepare for the following sheet discharge. As the operational sequence described above is repeated, a plurality of sheets are deposited in each bin, in which the sheets are aligned, with the side and rear edges being pushed against alignment reference member 2 and rear end stopper 9*b*, respectively. Since the aligning rod 5 is penetrating all the bins, the sheets in all the bins can be aligned at the same time as the aligning rod 5 is oscillated as described above. Then, it is automatically recognized whether or not the sheets are to be bound. When the stapling mode has not been selected, the operation ends at this point. It is needless to say that the sorting operation by a sorter without a stapler also ends at this point.

First Operational Embodiment

Next, the outline of a sorting operation in which the stapling mode has been selected will be described.

Figure 13C:
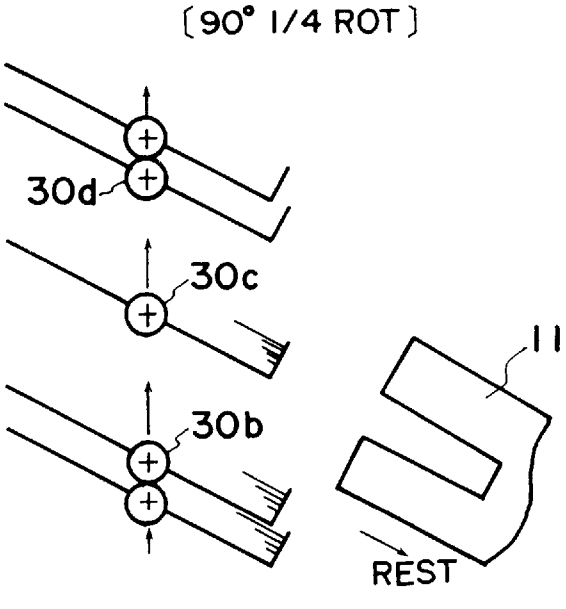
FIGS. 13(*a, b* and *c*) are drawings depicting the operational sequence of the first embodiment of the present invention.
Figure 13B:
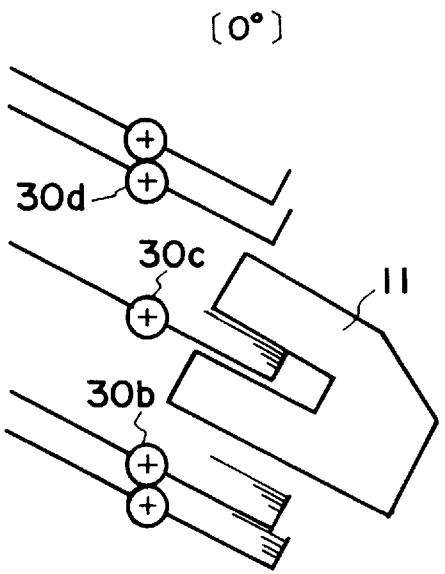
Figure 13A:
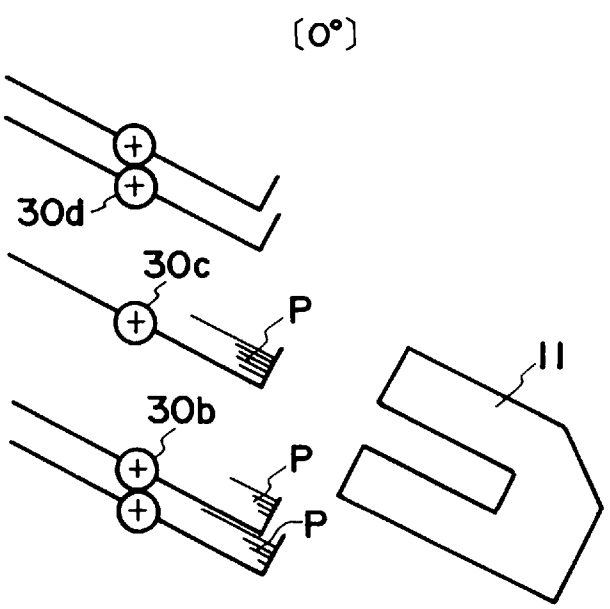

When the stapling is started from the first bin (30*c*), the lead cam, bin rollers, and stapler stand by, maintaining the state depicted in FIGS. 5 and 13(*a*).

Stapling in First Bin:

The stapler unit oscillating motor 108 (hereinafter, oscillating motor) is turned on by a stapling signal, and then, it is stopped after rotating the link disk 17 half a revolution (FIGS. 13(*a*) and 13(*b*)).

As the presence of the sheet is detected by the sheet sensor 104, the stapler driving motor 112 is turned on to clinch the sheet. The stapler is provided with a revolution detecting sensor S1 (detects the gear rotation), and when the completion of a revolution (equivalent to one stapling action) is detected, the stapler driving motor is turned off (FIG. 13(*b*)).

At the same time, the stapler unit oscillating motor 108 and bin shifting motor 42 are turned on (FIGS. 13(*b*) and 13(*c*)).

Stapling in the Second and Subsequent Bins:

As for the relationship between the rotational speeds of the stapler unit oscillating motor 103 and bin shifting motor 42, it is regulated so that the lead cam 10 rotates a quarter of a revolution while the link disk 107 rotates half a revolution. While the lead cam 10 rotates from the position 0° to the position 90°, the bins are not shifted, and during this period, the stapler 11 is retracted.

As the lead cam is rotated a quarter of a revolution by the rotation of the bin shifting motor, the bin roller 30 is moved on the cam, from the level surface to slanted surface, and at this moment, the stapler unit oscillating motor is also turned on to rotate the link disk half a revolution, retracting the stapler unit to the position where the stapler unit does not interfere with the bins (FIG. 13(*c*)).

At this point, the stapler unit oscillating motor is turned off.

Figure 14C:
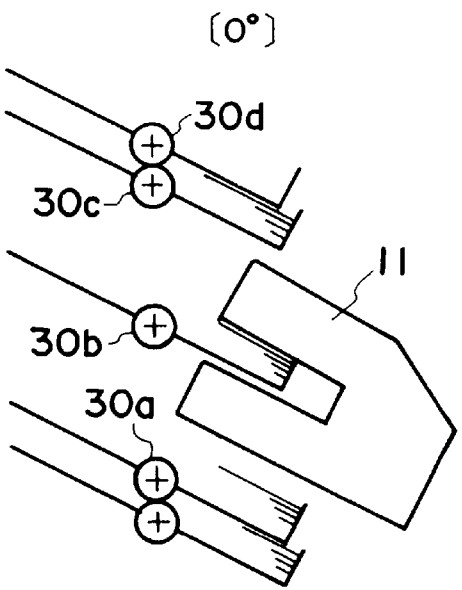
FIGS. 14(*a, b* and *c*) are also drawings depicting the operational sequence of the first embodiment.
Figure 14B:
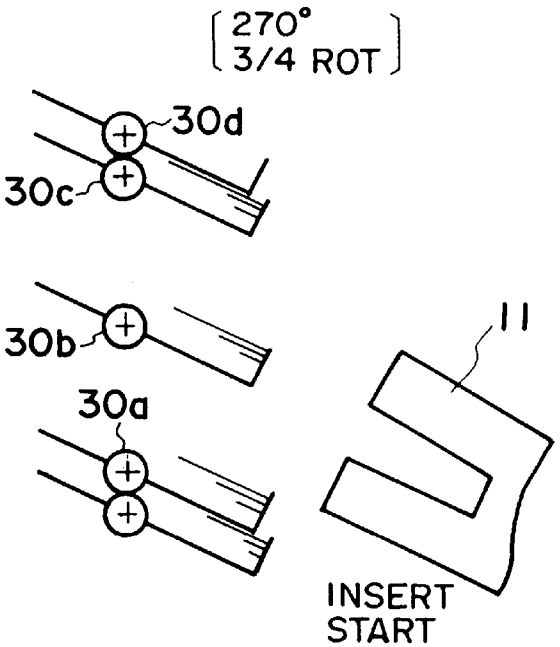
Figure 14A:
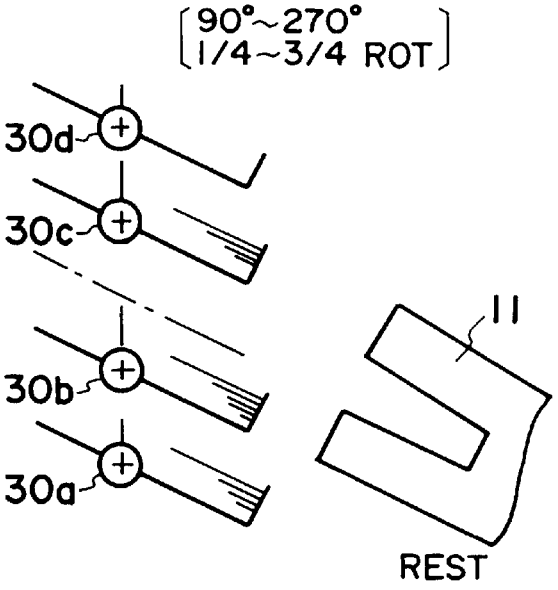

Then, as the bin shifting motor is rotated to rotate the lead cam an additional quarter of a revolution, the bin roller 30 reaches the mid point of the slanted surface of the lead cam (FIG. 14(*a*)). Next, as the lead cam is rotated another quarter of a revolution, the bin roller arrives at the level surface of the lead cam, allowing the stapler to be advanced or retracted (FIG. 14(*b*)).

Next, while the lead cam rotates the last quarter of a revolution, the oscillating motor is turned on and rotates at the aforementioned same speed, rotating the link disk half a revolution to advance the stapler into the void of the bins which is virtually standing still at the position 0°, and then, both motors are turned off (FIG. 14(*c*)). In this state, the stapler clinches the sheet set.

The operational sequence described above is repeated until the sheet set in the last bin is clinched. Thereafter, only the stapler unit oscillating motor is rotated half a revolution to return the stapling unit to the retracting position, ending the stapling operation.

The positional relationship between the bin roller and stapler at the aforementioned rotational angles of the lead cam and link disk is shown in FIG. 13(*a*)–FIG. 14(*c*) (in order to make it easier to comprehend the stapler unit movement, the stapler unit movement has been converted into a reciprocative linear movement).

It should be noted here that in this embodiment, the bin shifting motor and stapler unit oscillating motor are controlled so that they can be independently driven or stopped.

TABLE 1

| | Apparent Motion | | | |
|---|---|---|---|---|
| Angles | 0–90 | 90–180 | 180–270 | 270–360 |
| Pin Stapler | STOP RETRAC-TION | VERTICAL STOP | VERTICAL STOP | STOP ENTER |

Second Embodiment of Stapling Operation

Next, the outline of an operation in which the stapling mode is selected will be described. When the stapling is started from the first bin, the lead cam, bin rollers, bins and stapler stand by, maintaining the state illustrated in FIGS. 5 and 15(*a*).

Stapling in First Bin

Figures 15A, 15B, 15C:
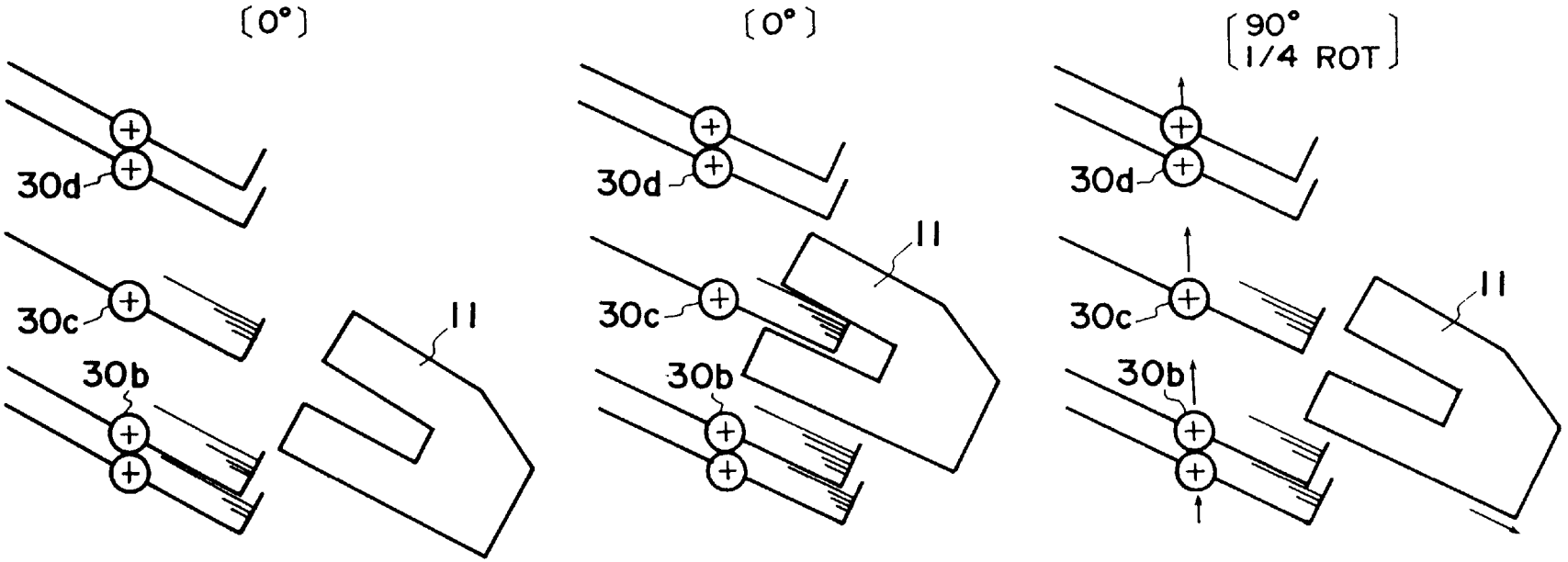
FIGS. 15(*a, b* and *c*) are drawings depicting the operational sequence of the second embodiment of the present invention.

The stapler oscillating motor 108 is turned on by a stapling signal, and is stopped after rotating the link disk 17 half a revolution (FIGS. 15(*b*)). As the presence of the sheet is detected by the sheet sensor 104, the stapler driving motor 112 is turned on to clinch the sheet (FIG. 15(*b*)). The stapler is provided with a revolution detecting sensor S1 (detects the gear rotation), and when the completion of a revolution (equivalent to one stapling action) is detected, the stapler unit oscillating motor 108 and bin shifting motor 42 are turned on at the same time (FIGS. 15(*b*) and 15(*c*)).

In this embodiment, both motors are constituted of a pulse motor, and the lead cam 10 and link disk 107 are rotated at the same frequency by means of using the same gear ratio from the first gear to the final gear and synchronizing the rotations of both motors.

Figure 16A:
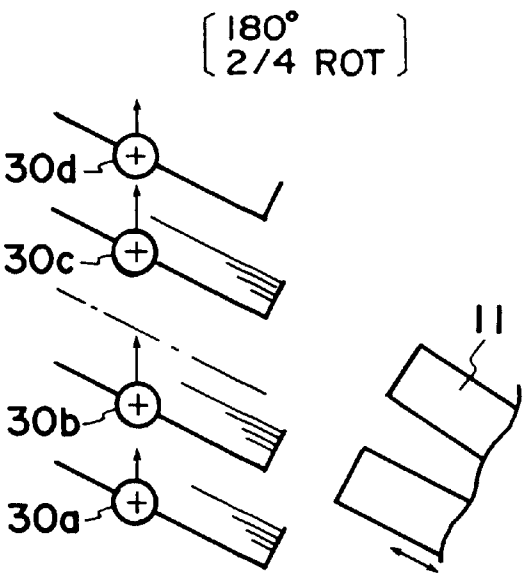
FIGS. 16(*a, b* and *c*) are also drawings depicting the operational sequence of the second embodiment.
Figure 16B:
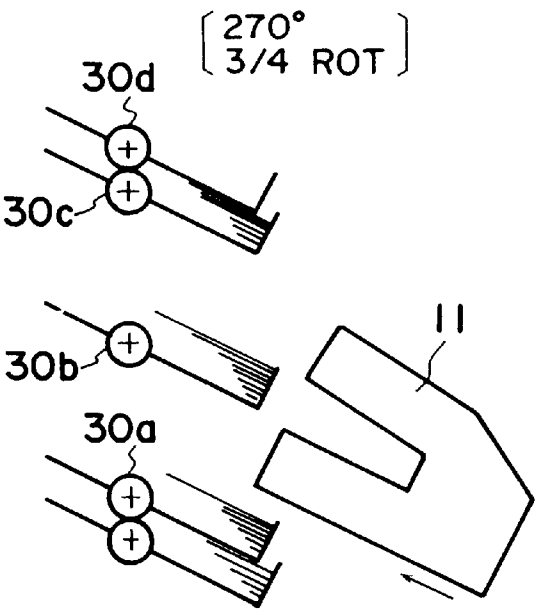
Figure 16C:
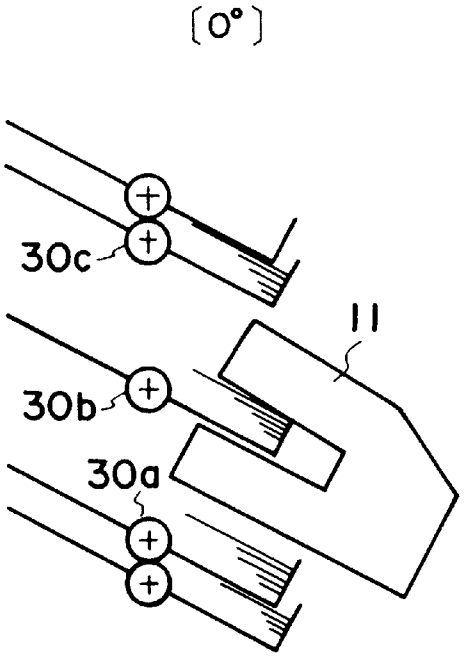

As the operational portions (link disk and lead cam) connected to the corresponding motors are rotated a quarter of a revolution (position 90°), the bin roller 30 moves on the lead cam, from the level surface to the slanted surface, and the stapler unit retracts toward the position where it does not interfere with the bin (FIG. 15(*c*)). As they are rotated an additional quarter of a revolution, the bin roller 30 reaches the midpoint of the slanted surface of the lead cam, and the stapler unit is completely retracted (FIG. 16(*a*)). Next, as they are rotated another quarter of a revolution (from the position 180° to the position 270°), the bin roller arrives at the level surface of the lead cam (position 270°), and the stapler unit advances toward the void of the bin (FIG. 16(*b*). Next, while both motors rotate the last quarter of a revolution, the bin roller remains on the level surface; therefore, the bin remains virtually stationary, and meanwhile, the stapler unit oscillates to the stapling position. Then, both motors are turned off (FIG. 16(*c*)). In this state, the stapler clinches the sheet set.

The operational sequence described above is repeated the same number of times as the number of the bins. After the sheet set in the last bin is clinched, only the stapler unit oscillating motor is rotated half a revolution to return the stapler unit to the home position, ending the operation.

The positional relationship between the bin roller and stapler at the aforementioned rotational angles is shown in FIG. 15(*a*)–FIG. 15(*c*) (in order to make it easier to comprehend the stapler movement, the stapler movement has been converted into a reciprocative linear movement).

In conclusion, this embodiment is characterized in that the rotation of the bin shifting motor and the rotation of the stapler unit oscillating motor are synchronized, and while the bin shifting motor is rotating, the stapler unit oscillating motor is also rotating.

TABLE 2

| | Apparent Motion | | | |
|---|---|---|---|---|
| Angles (deg.) | 0–90 | 90–180 | 180–270 | 270–360 |
| Pin Stapler | STOP RETRAC-TION | VERTICAL RETRAC-TION | VERTICAL ENTER | STOP ENTER |

Next, the sorter control section in accordance with the present invention will be described.

Figure 17:
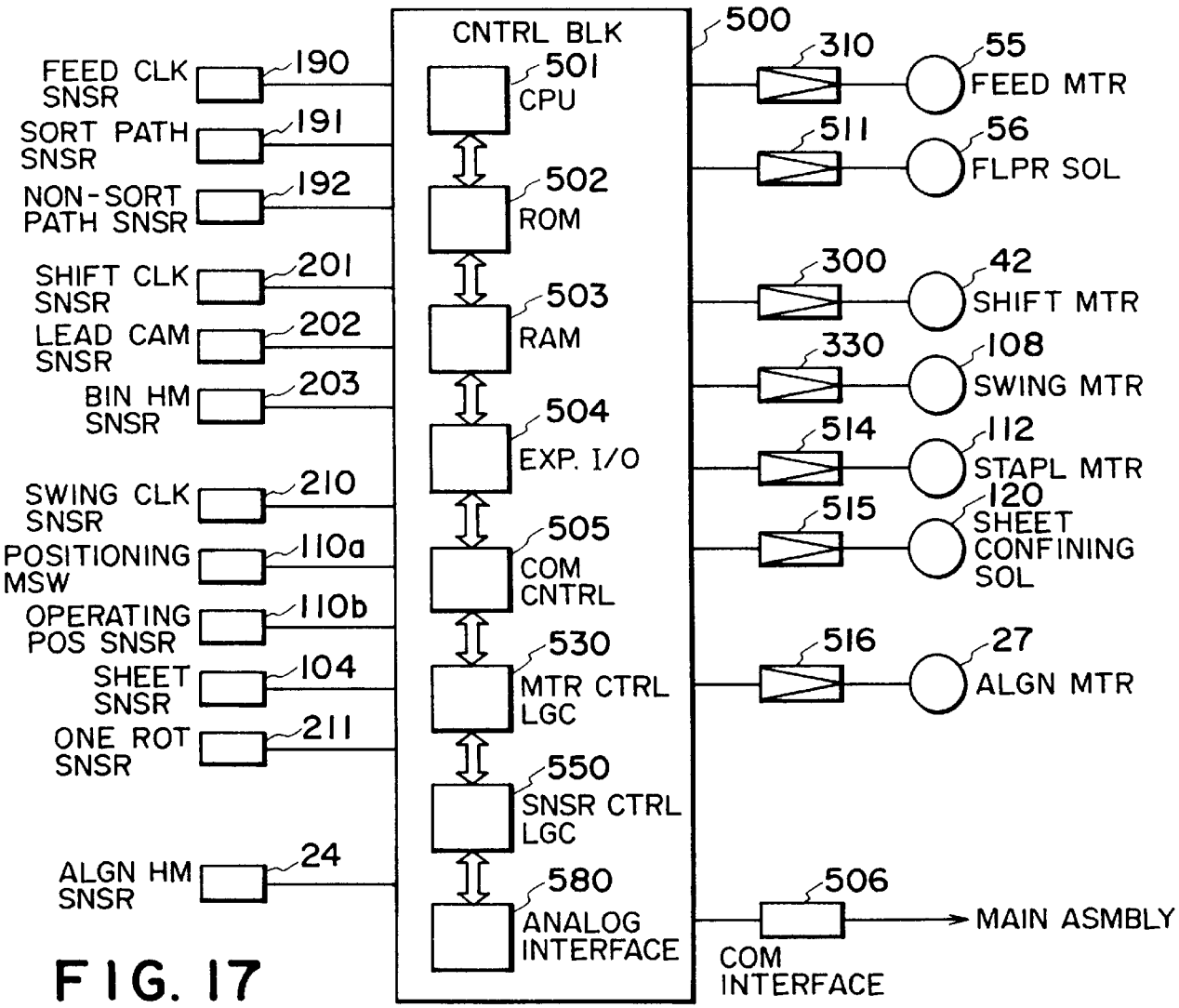
FIG. 17 is a block diagram of the sorter controlling section.

Sorter Control Section (FIG. 17):

FIG. 17 is a block diagram of the circuit structure of the control section in the sheet sorting apparatus in accordance with the present invention. The control circuit is centered around a control block comprising a microcomputer 501, an ROM 502, an RAM 502 backed up by a battery, an extended input/output section 504, a communication control section 505, a motor control section 530, a sensor control section 550, an analog interface constituted primarily of a D/A converter and A/D converter, and the like.

Sensor Input

The signals from various sensors are inputted to the input port of the microcomputer 501, and the input port of the extended input/output section 504.

The main inputs from the sensors are: (1) conveyer motor clock input 320 from a conveyer clock sensor 190, which is mounted on the motor shaft of a conveyer motor 55 to detect the motor revolution; (2) non-sort sensor input from a non-sort sensor 191 disposed at the entrance of a sheet conveying section 50; (3) sort sensor input from a sort sensor 192 disposed adjacent to the discharger roller of the sheet conveying section 50; (4) input from a shift clock sensor 201 for outputting a signal in synchronism with the rotation of the bin shifting motor 42; (5) input from a lead cam sensor 202 for detecting whether the bin roller 30 is on the level surface of the lead cam 10 (between the position 270° and 90° in FIG. 5), or slanted surface (between 90° and 270° in FIG. 5); (6) input from a bin home position sensor 203 for detecting whether or not the bin unit 1 is at the home position (position where the sheet is deposited in the bins; (7) input from an oscillation clock sensor 210 for outputting a signal in synchronism with the rotation of the stapler unit oscillating motor 108; (8) input from a position detecting microswitch 110*a* for detecting the positions of the cams 107*b* and 107*c* of the link disk 107; (9) inputs from an operating position detecting switch 110*b* for detecting the presence of the stapler unit 11 at the operable position, and a sheet detection sensor 104 for detecting whether or not the sheet is at the clinching position 117 of the stapler; (10) input from a revolution detecting sensor 211 for detecting the completion of one stapling action by the stapler unit 11; (11)

input from an aligning rod home position sensor 24 for detecting the presence of the aligning rod 5 at the home position; and the like.

Control Output

The aforementioned various loads are fed to the output ports of the microcomputer 501 and extended input/output section 504, through the motor control block 530 and various drivers. To describe essential drivers, a reference numeral 310 designates a conveyer motor driver for driving the conveyer motor 55; 511, a flapper solenoid driver for driving a flapper solenoid 56; 300, a bin shifting motor driver for driving the bin shifting motor 42; 330, a stapler unit oscillating motor driver for driving the stapler unit oscillating motor 108 for advancing or retracting the stapler unit; 514, a stapler motor driver for driving a stapling motor 112 which cause the stapler to staple; 515, a sheet pressing solenoid driver for driving a sheet pressing solenoid 120 which presses down the sheet 60 to prevent the sheet edge from lifting due to curling or the like, so that no sheet is left out when the stapler unit 11 staples the sheet set; and 516 designates an alignment motor driver for driving an alignment motor 27 which drives the aligning rod 5 for aligning the sheet set.

Analog Interface

A voltage proportional to the motor current of the conveyer motor 55 is inputted to the A/D converter terminal input of the analog interface 580, so that the sheet thickness can be detected using a method which will be described later. The detected motor current data are also used as the data for various self-diagnoses.

The receptor side of the sheet sensor 104 is connected to the other A/D converter terminal to monitor the sensor condition.

Signals for controlling the bin shifting motor current control output, which will be described later, and stapler unit oscillating current control output, and the like, that is, signals for controlling the motor torque, as well as signals for controlling the amount of the light emitted from the light emitting element of the sheet sensor 104, are outputted from the D/A converter output terminal of the analog interface.

Communication Interface

The sorter of this embodiment exchanges the control data with the main assembly of the copying machine, through data communication. As for the data to be received, there are size data for the sheet discharged from the main assembly of the copying machine, process speed data for the copying machine main assembly, data about the selected sorting operation mode such as nonsort mode, sort mode, group mode, and the like. As for the signal to be received, there are a sorting operation trigger signal, a sort preset initial signal, a stapling start signal, a bin shift direction reversal signal, a sheet discharge signal, a last sheet discharge signal, and the like.

As for the data to be transmitted, there are data about the number of usable bins, and as for the signal to be transmitted, there are a sheet arrival signal for notifying the sheet arrival from the copying machine, a sorter-standby signal for indicating that the sorter is on standby, a sorter-busy signal for indicating that the sorter is operating, a stapler-on signal for indicating that the stapler is stapling, various alarm signals for notifying the sorter malfunctions, and the like.

The control data described above are exchanged through the communication interface 506, under the control of the communication control section, which is primarily constituted of an unillustrated communication control IC.

Conveyer Motor Control Circuit

The conveyer motor 55 is a DC motor, and can be synchronously rotated with the bin unit shifting motor, using the PLL control. In addition, it can be controlled by a dedicated PWM control signal from the microcomputer 501, without involving the PLL control. The detailed block diagram therefore is given in FIG. 18.

The conveyer motor speed is controlled by the conveyer motor PWM signal 317 from the PWM output terminal of the microcomputer 501. The duty of the PWM output is computed using the initial duty factor value determined from the motor characteristic and load condition, and the digitized value of the correction voltage which develops at the analog/digital converter terminal as will be described later.

The conveyer motor driver is basically constituted of a drive transistor 312*a* and a fly wheel diode 311, so that it can be controlled using the PWM. Since it sometimes has to be quickly decelerated due to jamming or the like, a short brake transistor 312 is also included, and a control logic circuit 313 is designed so that, when the short brake signal 318 is outputted, priority is given to the braking operation.

A phase/frequency detector 314 is constituted of a commercial detector such as Toshiba TC919. The reference clock 319 of the phase/frequency detector is outputted from the microcomputer 501, and is compared with the conveyer motor clock 320 to output a voltage proportional to the correction amounts of the phase and frequency differences.

The output from the phase/frequency detector is inputted to a loop filter circuit constituted of an adder 315 and a lag-lead filter 316, to optimize the loop gain and correct the phase.

The output from the loop filter circuit is inputted to the analog/digital converter terminal of the microcomputer 501. The voltage generated at this time at the analog/digital converter terminal shows a value proportional to the correction value to be used to correct the duty factor of the PWM signal output 317 for controlling the conveyer motor.

Further, a capture signal 393, which indicates that the motor revolution is within a range lockable by the PLL control, is outputted from a phase/frequency comparator 314 to the microcomputer 501. This signal is outputted when the speed difference between the conveyer motor reference clock 319 and conveyer motor clock 320 is reduced to approximately 5% or less.

Figure 18:
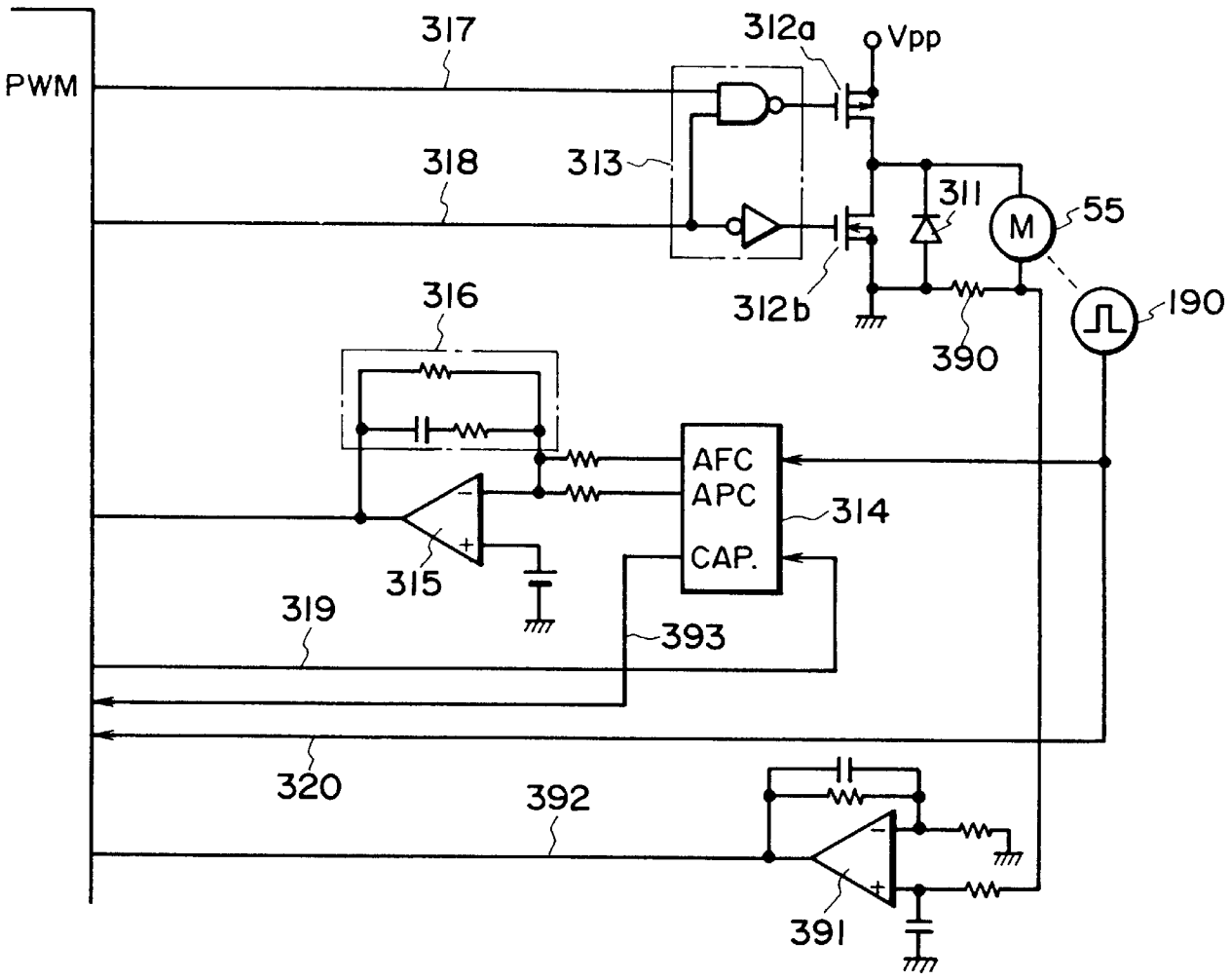
FIG. 18 is a block diagram of the circuit of the conveyer motor controlling section.

Referring to FIG. 18, a current detector resistor 390 is disposed between the conveyer motor 55 and fly wheel diode 311, so that the motor current can be detected independently of the PWM control of the conveyer motor 55. The motor current signal obtained through the current-voltage conversion is amplified through an amplifier 391, being outputted as a conveyer motor current signal 392, and is inputted to the A/D input terminal of the microcomputer 501.

Next, the control circuit of the first embodiment will be described.

Bin Shifting Motor Control Circuit

Figure 21:
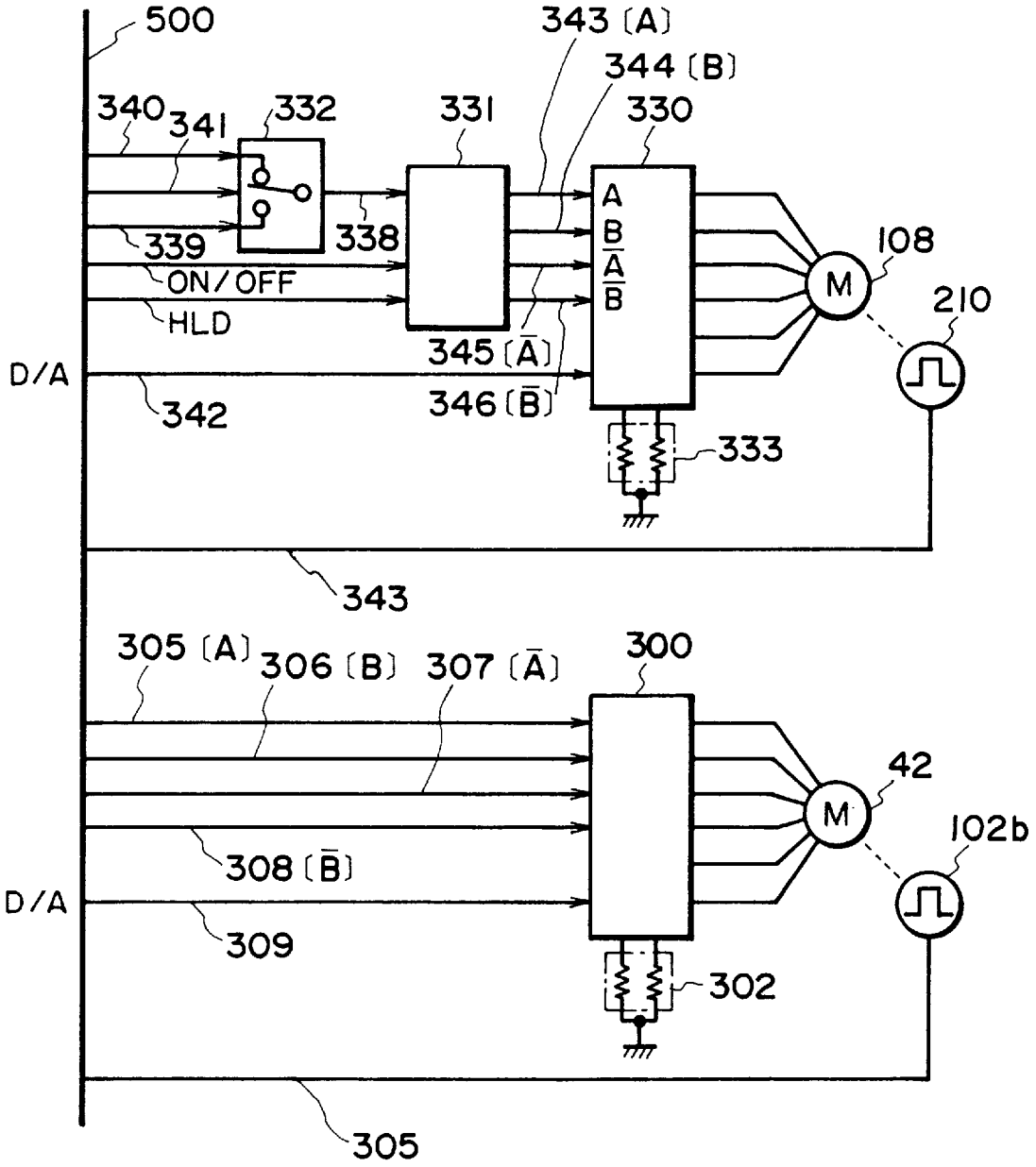
FIG. 21 is a block diagram of the control sections for the bin shifting motor and the cam oscillating motor in the second embodiment.

The description of the bin shifting motor control circuit is the same as the one for FIG. 21.

Stapling Unit Oscillating Motor Control Circuit

Figure 19:
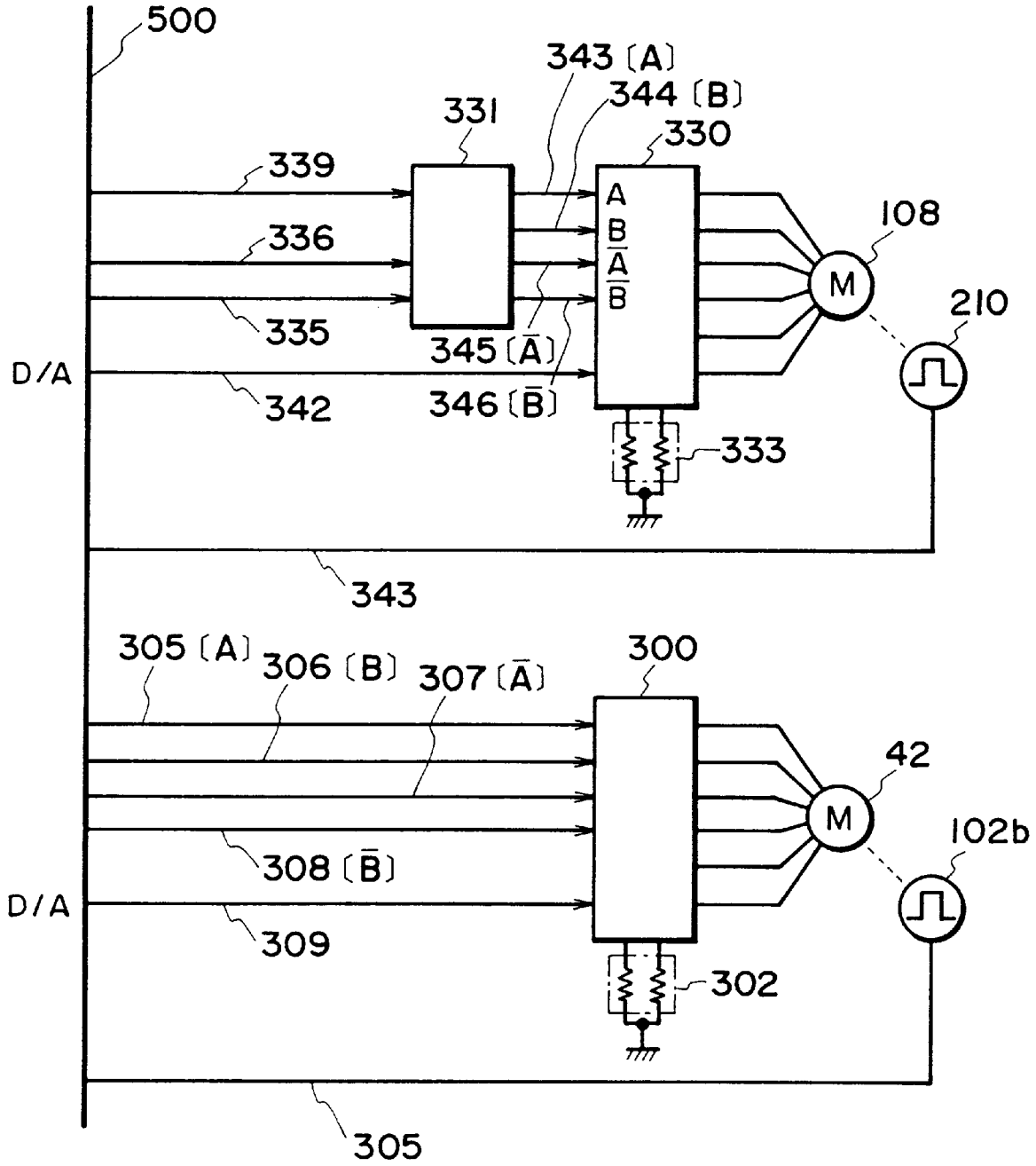
FIG. 19 is a block diagram of the oscillating motor controlling section of the first embodiment.

The stapler unit oscillating motor 108 is a four phase stepping motor, and the detailed block diagram of its driver section is given in FIG. 19.

As for the stapling unit oscillating motor driver 330, a commercial driver such as the constant current driver SLA7026M (a product of Sankei Denki), for example, may be employed.

Phase excitation control signals 343, 344, 345 and 346 to the stapler unit oscillating motor driver 330 are generated using a controller IC 331. As for the controller IC 331, a commercial controller IC such as TA842 (product of Toshiba) or the like may be employed.

The oscillation control IC 331 receives an on/off control signal for the stapling unit oscillating motor, and a holding control signal 335 for the stapler unit oscillating motor, from the control block 500.

As for the excitation clock to the control IC 331, an oscillation control clock 339 from the microcomputer 501 of the control block 500 is inputted.

The current value of the stapler unit oscillating motor 108 can be controlled by the current control signal for the stapler unit oscillating motor, which is outputted from the analog interface 580 of the control block 500. It can be optionally changed to control the motor torque as needed, for example, when the motor is started up, and when the motor is temporarily stopped.

Across the opposing ends of the current detection resistor 33, a voltage proportional to the stapler unit oscillating motor current appears. This voltage is controlled to be equalized to the output voltage from the current control signal 342 for the stapler unit oscillating motor.

The oscillation clock sensor 210 is mounted on the motor shaft of the stapler unit oscillating motor, and the oscillation motor clock 343 from the oscillation clock sensor 210 is inputted to the microcomputer 501 to be used for detecting the step-out of the stapler unit oscillating motor 108.

Embodiment of Stapling Operation Control

Figure 20:
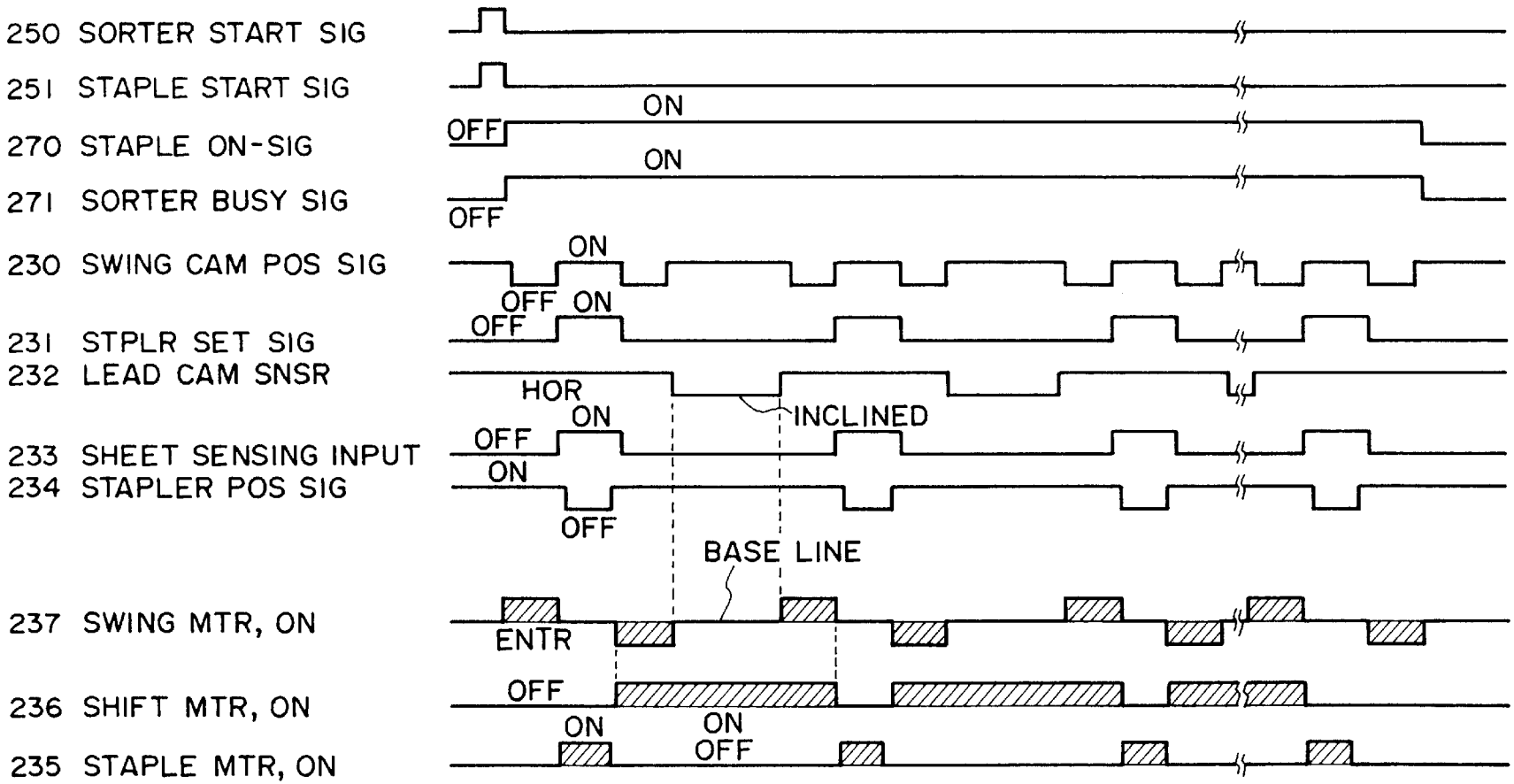
FIG. 20 is a timing chart for the first embodiment.

FIG. 20 is a timing chart for an embodiment of the stapling operation control in the sorter in accordance with the present invention. A reference numeral 250 designates a sorter operation start trigger signal sent from the main assembly of the copying machine, through the communication interface; 251, a stapling start signal, which is also sent from the copying machine main assembly, through the communication interface; 270, stapler-on signal, which is transmitted from the sorter to the copying machine main assembly through the communication interface to indicate that stapling is going on; 271, a sorter-busy signal, which is also transmitted from the sorter to the copying machine main assembly through the communication interface to indicate that sorting is going on; 230, an oscillation cam position signal from the position detecting microswitch 110*a;* 231, a stapler-set signal from the operating position detecting switch 110*b;* 232, a lead cam sensor input from the lead cam sensor 202; 233, a sheet detection input from the sheet detection sensor 104; and 234 designates a stapler home position signal from the full revolution detection sensor 211. A reference numeral 235 designates a timing chart showing the timing with which the stapling motor 112 is turned on or off by the stapling motor-on signal, wherein the portions hatched with slanted lines designate the on-periods; 236, a timing chart showing the timing with which the bin shifting motor is turned on, wherein the hatched portions designate the on-periods; 237, a timing chart showing the timing with which the stapler unit oscillating motor is turned on, wherein the hatched portions designate the on-periods, the hatched portions above the base line indicating the period in which the stapler unit 11 is in the void of the bin, and the hatched portions below the base line indicating the period in which the stapler unit 11 has been retracted from the bin.

Next, how various controls are executed by the CPU 501 will be described.

Referring to FIG. 20, as the sorting starts signal 250 and stapling start signal 251 are transmitted from the copying machine main assembly, the CPU 501 detects the start-up edges of the signals, and determines whether or not the bin roller 30 is at the substantial center (adjacencies of the position 0° in FIG. 5) of the level portion of the lead cam 10, on the basis of the input 232 from the lead cam sensor 202. When the bin roller 30 is not in this area, the CPU 50 activates the bin shifting motor 42 to move the bin roller 30 to the position 0°. This can be accomplished by rotating the lead cam 10 by 90° from the point where (when) the lead cam sensor signal changes from the OFF state (L level) to the ON state (H level) (position 270° in FIG. 5).

When it is determined that the bin roller 30 is at the substantial middle of the level portion, the oscillation hold signal 335 in FIG. 19 is switched from the hold state (L level) to the motor-drivable state (H level). Also, the oscillation motor current control signal output 342 in FIG. 19 is changed from the level correspondent to the hold period to the level correspondent to the driving period, though this step is not included in FIG. 20.

Further, the CPU 501 outputs an oscillation control clock 339, the frequency of which is gradually increased to a target pulse rate so that the acceleration pattern of the motor matches a well-known profile. After this clock 339 is developed into the phases, the driving pulses are supplied to the oscillation motor 108 through the oscillation motor driver 330, beginning the rotation. At the same time, the sorter-busy signal 271 and stapler-on signal 270 are switched from the OFF state to the ON state, and are transmitted to the copying machine main assembly. As the copying machine main assembly detects the start-up edges of the sorter-busy signal 271 and stapler-on signal 270, which have been transmitted, it switches the aforementioned sorting start signal 250 and stapling start signal 251 to the OFF state, and transmits them to the sorter side.

Meanwhile, as the oscillation motor 103 is turned on, the stapler unit 11 gradually begins to move from the state illustrated in FIG. 13(*a*). The oscillation cam position signal 230 from the position detecting microswitch 110*a* switches from the ON state to the OFF state, and switches back to the ON state as the state illustrated in FIG. 13(*b*) is almost realized, and about this time, the stapler-set signal 231 from the operating position detecting switch 110*b* is also turned on. After detecting the ON states of these two signals, the CPU 501 commands the oscillation motor to stop. The deceleration of the motor at this time follows a pattern which is completely reverse to the aforementioned constant acceleration profile. The aforementioned link disk 107 is rotated half a full turn through the sequential operations described above.

After stopping the oscillation control clock 339 (after the oscillation motor 108 stops), the CPU 501 lowers the oscillation motor hold signal 335 to the level correspondent to the hold period (L level), and changes the level of the oscillation motor current control signal output 342 from the drive level to the hold level at the same time.

Next, the sheet detection signal 233 from the sheet detection sensor 104 is checked. When it is in the OFF state, it is determined that the sheet set 60 is not present, and the subsequent stapling operation follows. The presence or absence of the sheet is detected in all bins by this sheet detection sensor 104.

When the sheet detection signal is in the ON state, the stapling motor 112 is turned on (by the DC motor under timing control) to clinch the sheet set 60. As the stapling motor 112 is turned on, the state of the stapler home signal 234 from the full revolution sensor 211 changes from the ON state to the OFF state. The state of the stapler home signal 234 is switched again to the ON state at the moment when the top unit 115 of the stapler comes back to the home position after the completion of the clinching operation. After detecting that this stapler home signal 234 is in the ON state, the CPU outputs a control signal to turn off the stapling motor 112.

At the moment when the stapling operation in the first bin is completed through the sequence described above, the stapler is standing by, in the state illustrated in FIG. 13(*b*).

Next, the CPU 501 switches the state of the oscillation motor hold signal 335 from the hold state (L level), to the motor-drivable state (H level), as it does during the stapling operation for the first bin. The levels of the oscillation motor current control signal output 342 in FIG. 19, and the shift motor current control signal output 309, are changed from the hold level to the drive level, though this change is not illustrated in FIG. 20.

Next, the well-known 1–2 phase excitation pattern is generated in the shift motor phase excitation outputs 305–308. The acceleration pattern in this case also has a constant acceleration profile, in which the bin shift motor is controlled to begin rotating at a constant speed after it reaches the target speed.

At the same time, the oscillation control clock 339 is outputted to turn on both shift motor 42 and oscillation motor 108. The acceleration pattern at this time is also the same as the one described above. The rotational speed of the oscillation motor 108 at this time is controlled in such a manner that it takes exactly the same length of time for the stapler 11 to complete its advancement as the time it take for the lead cam 10 to rotate 90°.

As the oscillation motor 103 is turned on, the oscillation cam position signal 230 switches from the ON state to the OFF state, and then, it switches back to the ON state as the stapler unit nears the retracting position in FIG. 13(*c*). After detecting the start-up of the oscillation cam position signal 230, the CPU 501 turns off the oscillation motor 108 to stop the stapler unit 11 at the retracting position. By this moment, the bin roller 30 reaches the position 90° of the development in FIG. 5.

The bin shifting motor 42 alone continues its rotation, rotating thereby the lead cam 10 to the position 270° of the development in FIG. 5; in other words, the lead cam 10 rotates three quarters of a revolution after the bin shifting motor is turned on. The bin roller 30 moves onto the level portion of the lead cam 10 at this position 270°, and the lead cam sensor output 232 is switched from the OFF state to the ON state.

As the CPU 501 detects the change of the lead cam sensor output, it turns on the oscillation motor 108. As a result, the stapler unit 11 advances again toward the bin, but since the bin roller 30 is already moving on the level portion of the lead cam 10, the stapler and the bin do not interfere with each other. The rotational speed of the oscillation motor 108 at this time is controlled in the same manner as when the stapler unit 11 is retracted; it is controlled in such a manner that it takes exactly the same length of time for the stapler to complete its advancement as the time it takes for the lead cam 10 to rotate 90°.

As the oscillation motor 108 is turned on, the oscillation cam position signal 230 is switched from the ON state to the OFF state as it is in the case of the stapling operation involving the first bin, and then, is switched back to the ON state as the stapler unit nears the position illustrated in FIG. 13(*b*). At substantially the same time, the stapler-set signal 231 from the operating position detecting switch 110*b* is also switched to the ON state.

As the CPU detects the ON states of both signals, it commands the bin shifting motor 42 and stapler unit oscillating motor 108 to stop. At this time, the motors are decelerated following a pattern which is completely reversal to the aforementioned constant acceleration profile. Since the deceleration speed is controlled in such a manner that it takes exactly the same length of time for the stapler 11 to complete its advancement as the time necessary for the lead cam 10 to rotate 90°, the lead cam 10 stops substantially at the position 0° of the development in FIG. 5.

The clinching operation in the second bin and the subsequent stapling operations are the repetitive of the operations described above; therefore, their detailed descriptions will be omitted. After the stapling operations for the necessary number of the bins are finished, the stapler unit 11 is standing by in the state illustrated in FIG. 13(*b*). Since the next sorting operation is impossible in this state, the CPU 501 activates the oscillation motor 108 alone to retract the stapler unit 11. Also at this time, a control is executed for switching the state of the oscillating motor 108 from the hold state to the drive state, but since this control is the same as those described previously, its description will be omitted.

During the retracting operation, the stapler unit 11 moves from the position illustrated in FIG. 13(*b*) to the position illustrated in FIG. 13(*c*). As the stapler 11 nears the position illustrated in FIG. 13(*c*), the oscillation cam-on signal 230 is switched from the OFF state to the ON state. The CPU stops the oscillation motor 108 as it detects this switch. At this time, the sorter switches the states of the staple-on signal 270 and sorter-busy signal 271 from the ON state to the OFF state, and sends them to the copying machine main assembly. Receiving these signals, the copying machine main assembly determines that the stapling operation sequence by the sorting apparatus has been completed.

Next, the control circuit of the second embodiment will be described.

Bin Shifting Motor Control

FIG. 21 is a detailed block diagram for the bin shifting motor control.

The shift motor 42 is constituted of a four phase stepping motor. As for the shift motor driver 300, a commercially available constant current driver in the form of an IC, such as a stepping motor driver SLA7026M made by Sankei Denki, is employed. The well-known four phase shift motor excitation control signals 305, 306, 307 and 308 are inputted from the microcomputer 501 to the shift motor driver 301, and the shift motor current control signal 309, which is an analog voltage for controlling the motor driving current, is also inputted to the shift motor driver 301 from the analog interface 580. The rotational speed of the shift motor 42, that is, the rotational speed of the lead cam 10, can be optionally changed by changing the pulse rates of these shift motor excitation control signals 305, 306, 307 and 308. Further, the motor torque can be changed by changing the voltage level of the shift motor current control signal 309, depending on the following conditions: whether the shift motor 42 is to be started up, is being accelerated, or is being rotated at a constant speed; whether the bin roller is on the level portion of the lead cam 10, or on the slanted portion of the lead cam 10; whether the number of the sheets accumulated in each bin is large or small; where the bin position is; and the like. The shift current detector resistor 302 is used for feeding back the current to control the shift motor current.

Further, the shift motor clock 305 from the belt clock sensor 201 is inputted to the microcomputer 501, so that the step-out of the shift motor 42 can be detected.

Oscillation Motor Control Circuit

The oscillation motor 108 is a four phase stepping motor, and the detailed block diagram of its driver section is also given in FIG. 21.

As for the oscillation motor driver 330, a commercially available IC driver, such as constant current driver SLA 7026M made by Sankei Denki, is employed.

The phase excitation control signals 343, 344, 345 and 346 are generated using the control IC 331. The control IC 331 may be constituted of a commercially available component such as a control IC TA8425 made by Toshiba, or the like.

To the oscillation control IC 331, the ON/OFF control signal 336 for the oscillation motor, and the oscillation motor hold control signal 335 are inputted from the control block 500.

As for the pulse rate clock 338, either the oscillation control clock 339 from the microcomputer 501 in the control block 500, or the shift excitation clock 340 which serves as the reference for generating the shift motor excitation signals 305, 306, 307 and 308, are inputted to the control IC 331. Switching between two clocks is carried out by a clock selector circuit 332.

The clock selector circuit 332 receives a clock switching signal 341 from the control block 500. When the clock switching signal 341 is at a low level, a shift excitation clock 341 is inputted to the oscillation control IC 331, and the oscillation motor 108 rotates in synchronization with the shift motor 42.

When the clock switching signal 341 shows a high level, an oscillation control clock 339 is inputted to the oscillation control IC 331, and the oscillation motor 108 is allowed to rotate independently.

The current value of the oscillation motor 108 can be controlled like the current value of the shift motor 42, by the oscillation motor current control signal 342 outputted from the analog interface 580 in the control block 500; it can be changed to control optionally the motor torque as needed, for example, when the motor is started up, or temporarily stopped.

A voltage proportional to the oscillation motor current appears at both ends of the current detection resistor 333, and a control is executed to match this voltage with the output voltage from the oscillation motor current control signal 342.

On the motor shaft of the oscillation motor, the oscillation clock sensor 210 is mounted, and the oscillation motor clock 343 from the oscillation clock sensor 210 is inputted to the microcomputer 501, to be used for detecting the step-out of the oscillation motor 108.

Embodiment of Stapling Operation Control

Figure 22:
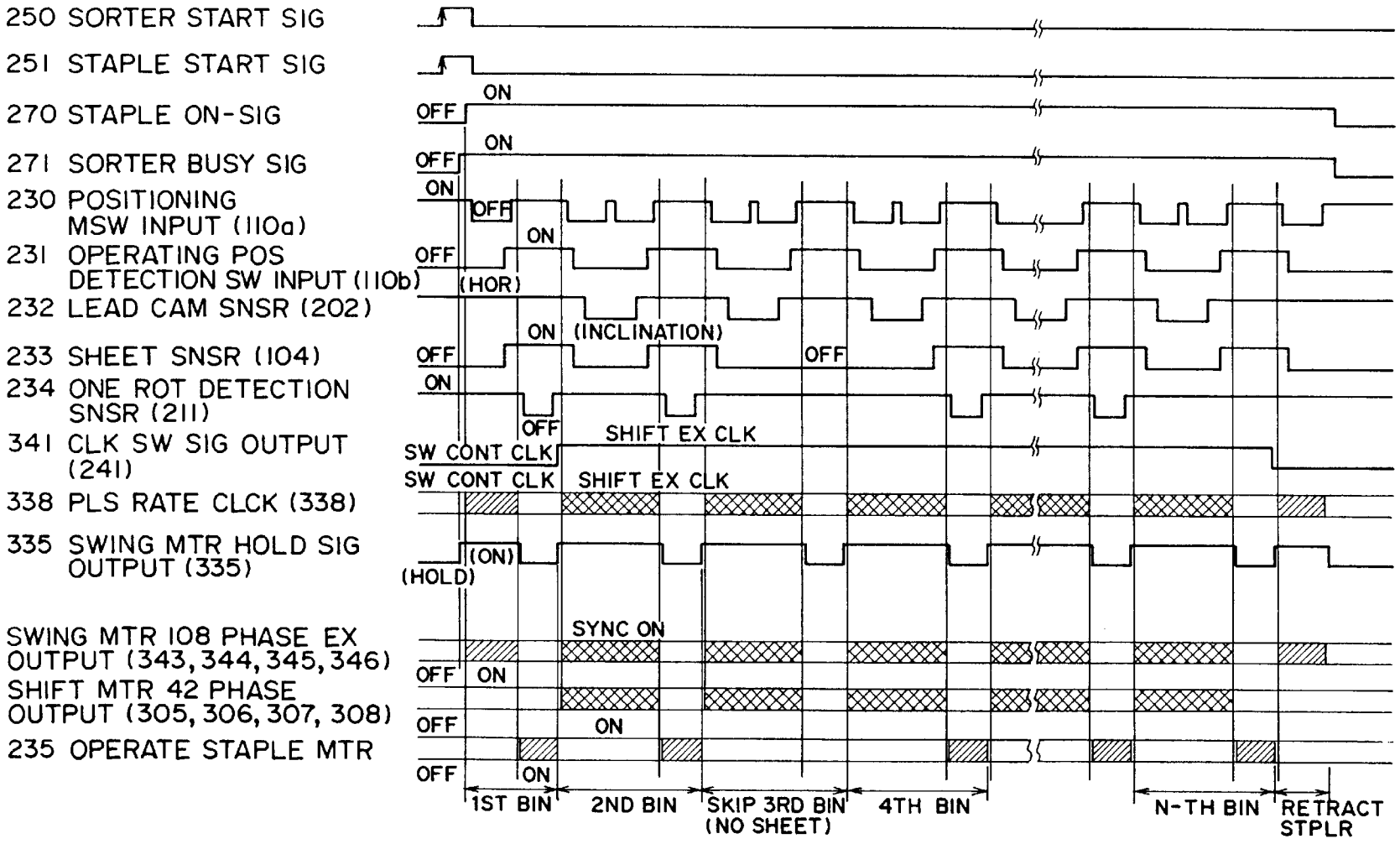
FIG. 22 is a timing chart for the second embodiment.

FIG. 22 is a timing chart of the second embodiment of the stapling operation control of the sorter in accordance with the present invention. A reference numeral 250 designates a sorter operation start trigger signal transmitted from the copying machine main assembly through the communication interface; 251, a stapling start signal for demanding to start the stapling operation, which is also transmitted from the same source; 270, a stapler-on signal, which is transmitted from the sorter to the copying machine main assembly through the communication interface, to indicate that a stapling operation is going on; 271, a sorter-busy signal, which also is transmitted from the sorter to the copying machine through the communication interface, to indicate that the sorter is operating; 230, an oscillation cam position signal from the position detecting microswitch 110*a;* 231, a stapler-set signal from the operating position detecting switch 110*b*; 232, a lead cam sensor input from the lead cam sensor 202; 233, a sheet detection input from the sheet detection sensor 104; 234, a stapler unit home position signal from the full revolution detection sensor 211; 341, the clock switching signal in FIG. 19; 338, the pulse rate clock in the same drawing; 335, an oscillation motor hold signal; 343–346, oscillation motor phase excitation clocks; and 305–308 designate shift motor phase excitation clock. A reference numeral 235 designates a timing chart showing the timing with which the stapling motor 112 is turned on or off by an unillustrated stapling motor-on signal.

Next, how controls are executed by the CPU 501 will be described.

Referring to FIG. 22, as the sorting start signal 250 and stapling start signal 251 are transmitted from the copying machine main assembly, the CPU 501 detects the start-up edges of the signals, and determines whether or not the bin roller 30 is on the level portion of the lead cam 10, on the basis of the input 232 from the lead cam sensor 202. When the bin roller 30 is not on the level portion, the CPU 50 activates the bin shifting motor 42 to move the bin roller 30 to the position 0° in FIG. 5.

When it is determined that the bin roller 30 is on the level portion, the logic of the clock switching signal output is switched so that the clock input to the control IC in FIG. 21 is switched to the oscillation control clock 339.

Next, the oscillation hold signal 335 is switched from the hold state (L level) to the motor-drivable state (H level). Also, the oscillation motor current control signal output 342 in FIG. 21 is changed from the level correspondent to the hold period to the level correspondent to the driving period, though this step is not included in FIG. 22.

Further, the CPU 501 outputs an oscillation control clock 339, the frequency of which is gradually increased to a target pulse rate so that the acceleration pattern of the motor matches a well-known profile. After this clock 339 is developed into each phase, the driving pulses are supplied to the oscillation motor 108 through the oscillation motor driver 330, beginning the rotation of the oscillation motor. At the same time, the sorter-busy signal 271 and stapler-on signal 270 are switched from the OFF state to the ON state, and are transmitted to the copying machine main assembly. As the copying machine main assembly detects the start-up edges of the sorter-busy signal 271 and stapler-on signal 270, which have been transmitted thereto, it switches the aforementioned sorting operation start signal 250 and stapling start signal 251 to the OFF state, and transmits them to the sorter side.

Meanwhile, as the oscillation motor 103 is turned on, the stapler 11 starts moving gradually from the state illustrated in FIG. 15(*a*). The oscillation cam-on signal 230 from the position detecting microswitch 110*a* switches from the ON state to the OFF state, and switches back to the ON state as the state illustrated in FIG. 15(*b*) is almost realized, and about this time, the stapler-set signal 231 from the operating position detecting switch 110*b* is also turned on. After detecting the ON states of these two signals, the CPU 501 commands the oscillation motor to stop. The deceleration of the motor at this time follows a pattern which is completely reverse to the aforementioned constant acceleration profile.

After stopping the oscillation control clock 339 (after the oscillation motor 108 stops), the CPU 501 lowers the oscillation motor hold signal 335 to the level correspondent to the hold period (L level), and changes the level of the oscillation motor current control signal output 342 from the drive level to the hold level at the same time.

Next, the sheet detection signal 233 from the sheet detection sensor 104 is checked. When it is in the OFF state, it is determined that the sheet set 60 is not present, and the subsequent step is followed. The presence or absence of the sheet is detected in all bins by this sheet detection sensor 104. The stapling sequence to be carried out when the sheet set 60 is not present is shown as the stapling sequence for the third bin in the timing chart given in FIG. 22.

When the sheet detection signal 233 is in the state of ON, the stapling motor 112 is turned on to clinch the sheet set 60. As the stapling motor 112 is turned on, the state of the stapler home signal 234 from the full revolution detection sensor 211 changes from the ON state to the OFF state. The state of the stapler home signal 234 is switched again to the ON state at the moment when the top unit 115 of the stapler comes back to the home position after the completion of the clinching operation. After detecting this stapler home signal 234 in the ON state, the CPU outputs a control signal to turn off the stapling motor 112.

At the moment when the stapling operation in the first bin is completed through the sequence described above, the stapler is standing by, in the state illustrated in FIG. 15(*b*).

Next, the CPU 501 switches the logic of the clock switching signal 341, so that the clock input to the control IC 331 in FIG. 21 is switched to the shift excitation clock 340.

Further, the oscillation hold signal 335 is switched from the hold state (L level), to the motor-drivable state (H level), as it is in the case of the stapling operation for the first bin. Also, the oscillation motor current control signal output 342 in FIG. 21 is changed from the level correspondent to the hold period to the level correspondent to the driving period, through this step is not included in FIG. 22.

Next, the well-known 1–2 phase excitation pattern is generated in the shift motor phase excitation outputs 305–308. With the same timing, the shift motor clock 340 is outputted, and is developed into the 1–2 phase excitation pattern by the control IC 331, so that the oscillation motor 103 is rotated. The acceleration pattern in this case is rendered the same as the stapling operation for the first bin. As described above, the lead cam 10 and link disk 107 of the oscillation unit have the same reduction ratio from the motor shaft to the final drive; therefore, when the shift motor 42 and oscillation motor 103 are synchronized, the upward bin movement equivalent to the bin thickness and advance-retract cycle of the stapler unit 11 are also synchronized. The description of the mechanical setup for preventing interference between the two components will be omitted here, since it was previously given.

As the shift motor 42 and oscillation motor 103 are turned on in synchronism, the stapler 11 starts moving gradually from the state illustrated in FIG. 15(*a*). The oscillation cam-on signal from the position detecting microswitch 110*a* is switched from the ON state to the OFF state, going through the state illustrated in FIG. 15(*b*), and is switched back to the ON state when the state illustrated in FIG. 16(*a*) is almost realized. At this time, no control is executed to stop the motors; both motors are allowed to continue rotating. As the stapler unit 11 moves beyond the stage illustrated in FIG. 16(*a*), the oscillation cam-on signal 230 is switched again from the ON state to the OFF state, going subsequently through the stage illustrated in FIG. 16(*b*), and as the stage illustrated in FIG. 15(*b*) nears, it is again switched back to the ON state. The sequence from this point on is the same as the stapling operation for the first bin. About this time, the stapler-set signal 231 from the operating position detecting switch 110*b* is changed to the ON state. After detecting that both signals are in the ON states, the CPU execute the control for stopping the shift motor 42 and oscillation motor 108. At this time, the motor deceleration is the same as the stapling operation for the first bin; a pattern which is completely reversal to the aforementioned constant acceleration profile is employed.

Thereafter, the stapling sequence is the same as the one for the first bin, and the stapling sequences for the third and subsequent bins are nothing but repetitions of the one for the second bin; therefore, their description will be omitted.

After the stapling operations for the necessary number of bins are finished as described above, the stapler unit 11 is standing by in the state illustrated in FIG. 15(*b*). Since the next sorting operation is impossible in this state, the CPU 501 flips the clock switching signal 341 back to the side of the oscillation control clock 339, so that the oscillation motor 108 can be independently activated in order to retract the stapler 11.

Also at this time, a control is executed for switching the state of the oscillating motor 108 from the hold state to the drive state, but since this control is the same as those described previously, its description will be omitted.

During the retracting operation, the stapler 11 moves from the position illustrated in FIG. 15(*b*) to the position illustrated in FIG. 15(*c*). As the stapler 11 nears the position illustrated in FIG. 15(*c*), the oscillation cam-on signal 230 is switched from the OFF state to the ON state. The CPU stops the oscillation motor 108 as it detects this switch. At this time, the sorter switches the states of the staple-on signal 270 and sorter-busy signal 271 from the ON states to the OFF states, and sends them to the copying machine main assembly. Receiving these signals, the copying machine main assembly determines that the stapling operation sequence by the sorting apparatus has been completed.

In either of the aforementioned first and second embodiments, the rotation of the shift motor is stopped to hold the cam angle at 0° (correspondent to the substantial middle of the level portion). This is due to the following reasons. Since the clinching operation of the stapler varies in response to the sheet set thickness, the thicker the sheet set is, the more time, which is proportional to the thickness, is necessary to assure successful stapling. Further, as the shift motor and oscillation motor are controlled by the pulse motor, they can be easily synchronized, but since the clinching movement of the stapler is caused by the DC motor with a controlled timing, the synchronization of the clinching movement is not as easy; therefore, it is necessary to allow for synchronizing error.

However, since the intermittent rotation of the shift motor is effected when the level portion of the cam, which has little to do with the vertical movement of the bin, is involved, the bin weight change does not affect the motor; it has little impact on the motor. Therefore, the shift motor can be quiet while being driven intermittently.

Figure 23:
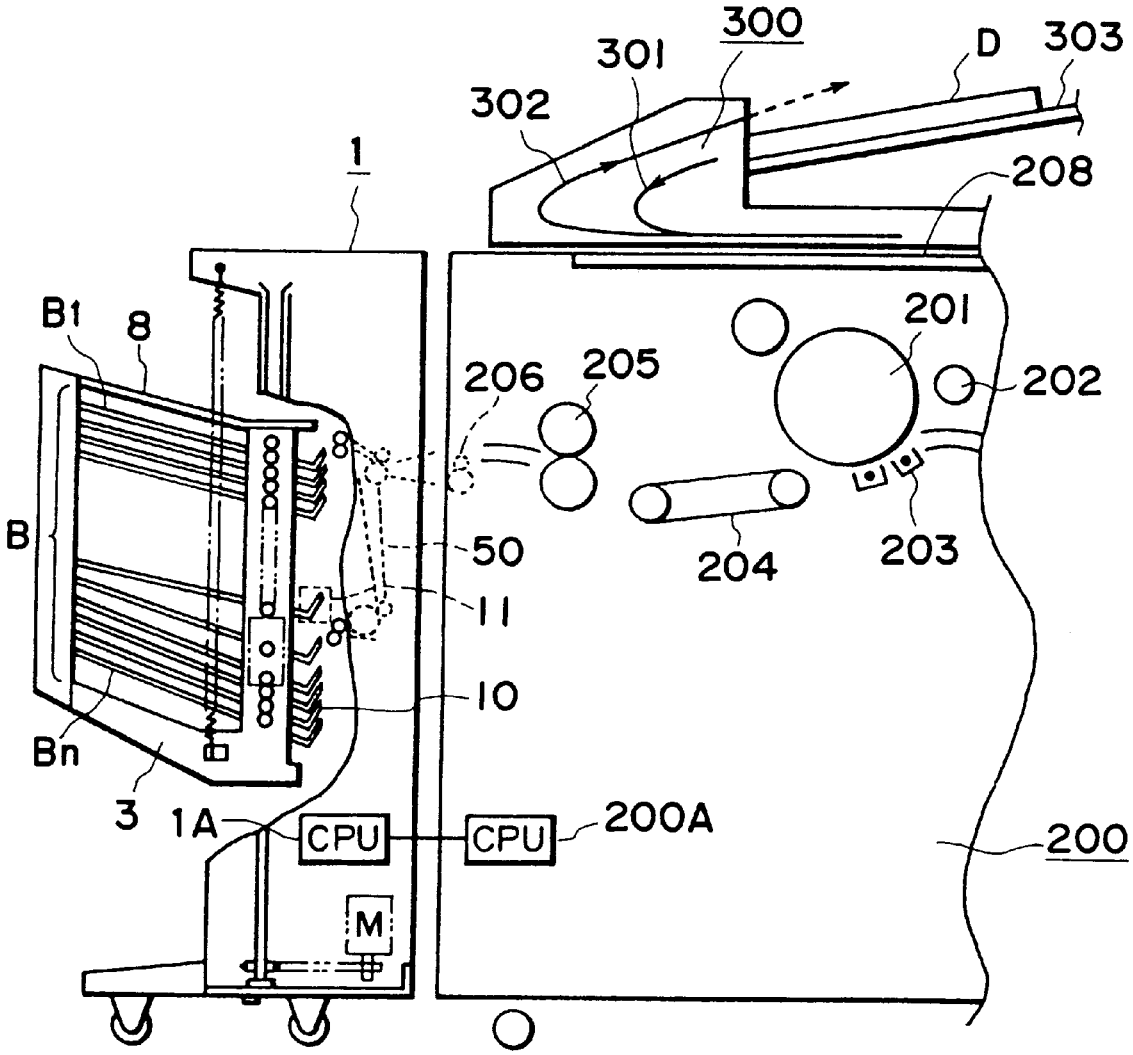
FIG. 23 is a vertical, sectional side view depicting a postsorting processing apparatus in accordance with the present invention, and an image forming apparatus comprising such a postsorting sheet processing apparatus.
Figure 24:
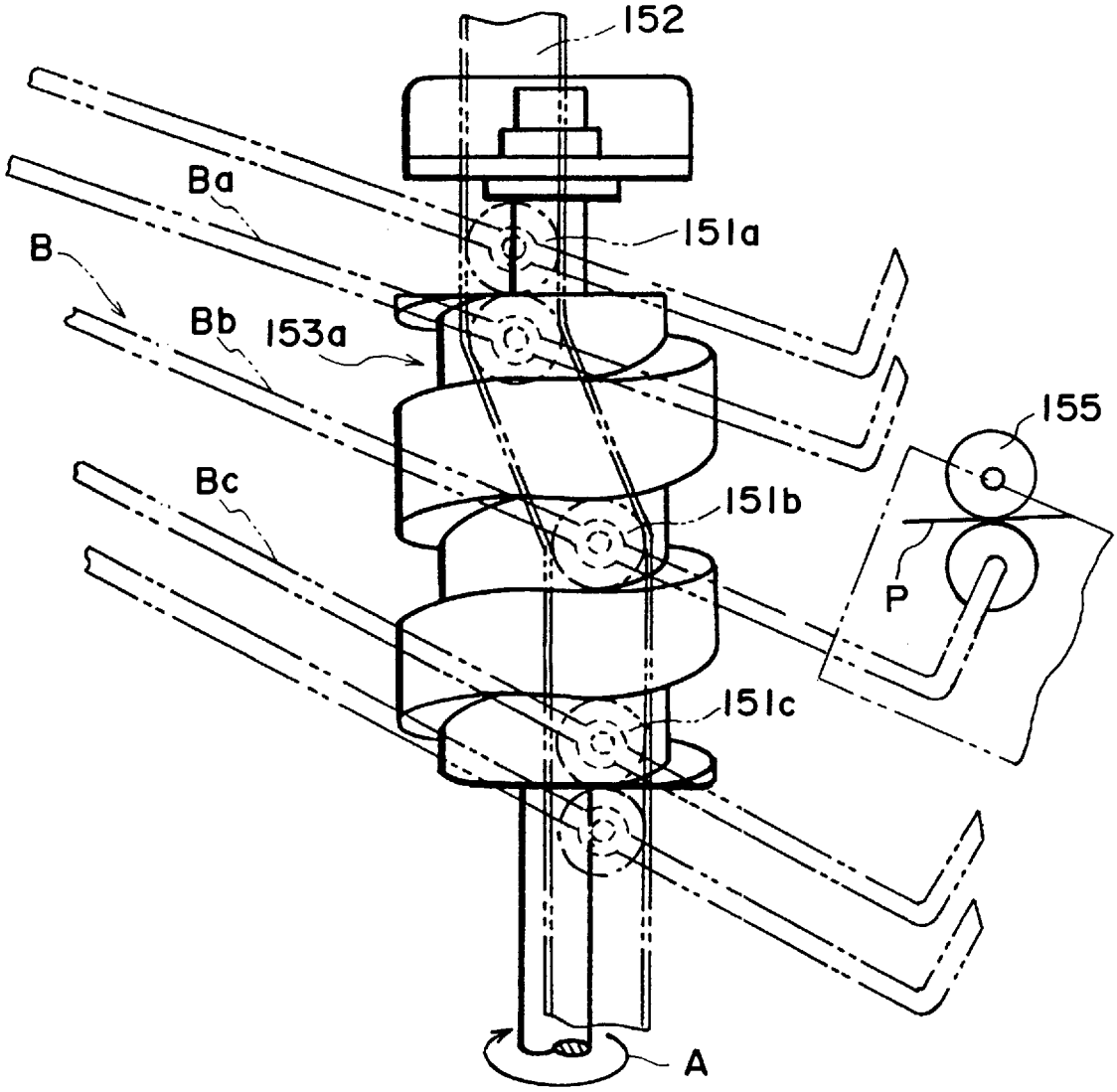
PRIOR ART FIG. 24
FIG. 24 is a side view of the essential portion of a conventional sorting apparatus.
Figure 25:
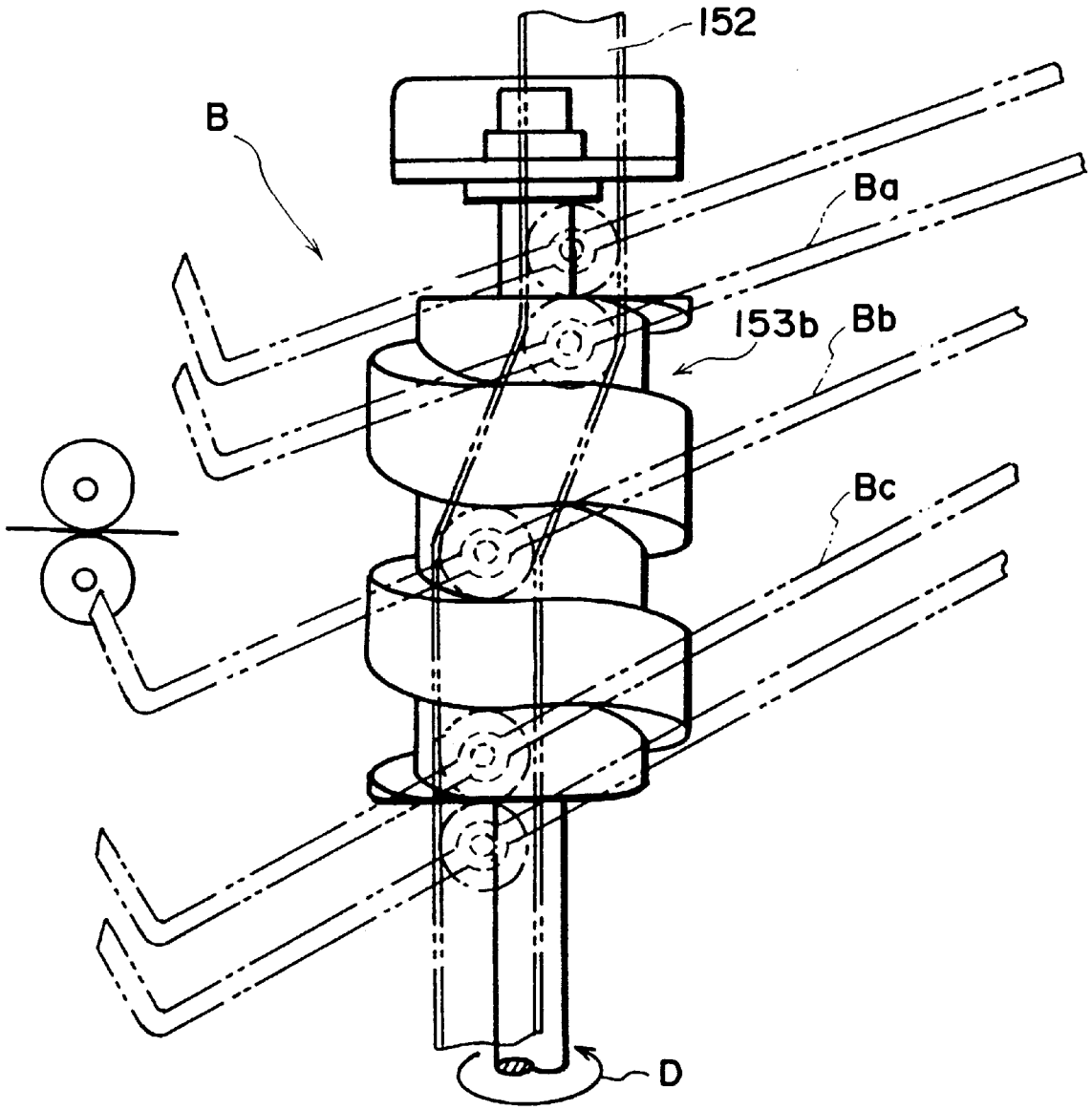
PRIOR ART FIG. 25
FIG. 25 is also a side view of the essential portion of the conventional sorting apparatus.
Figure 26:
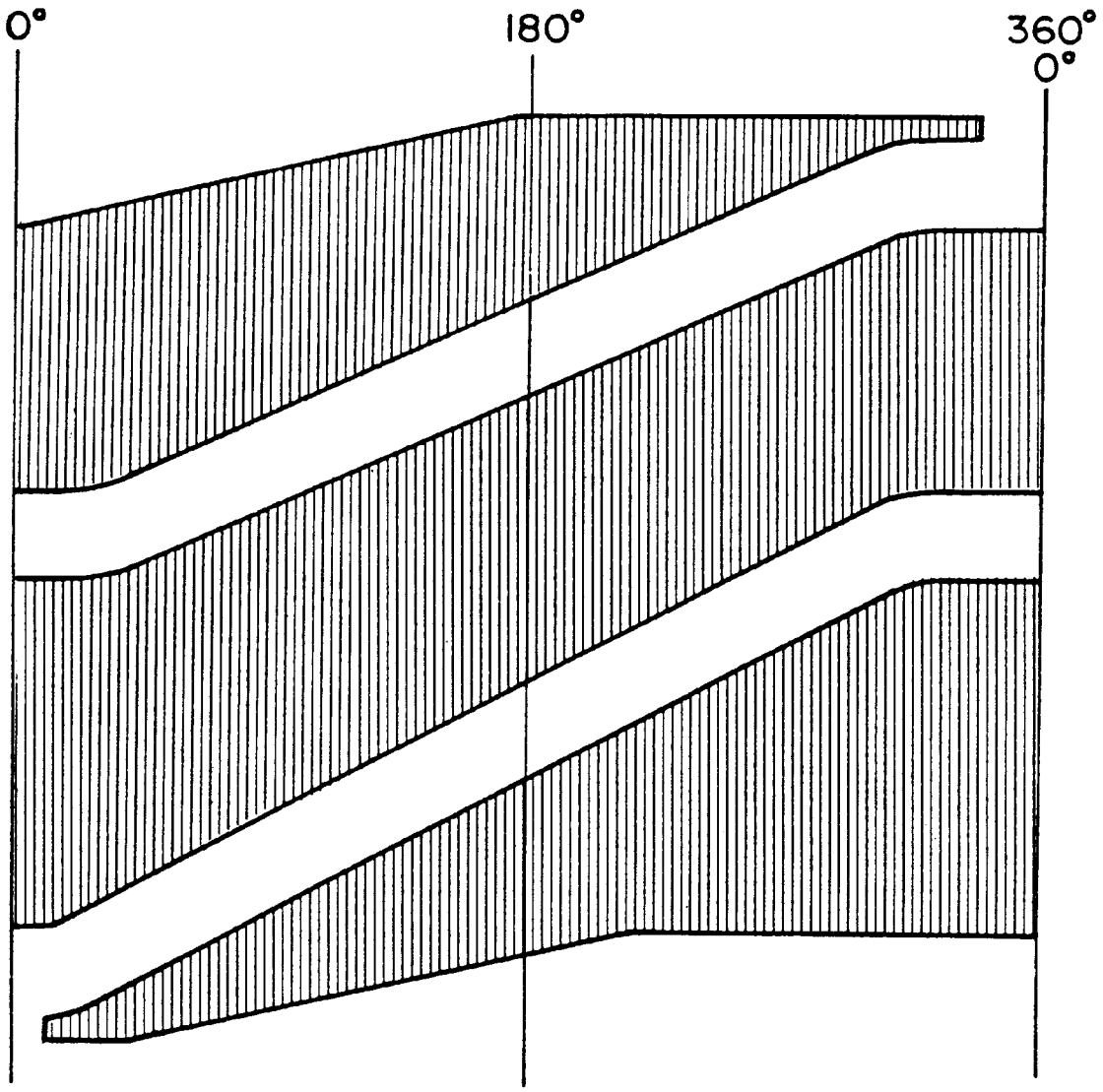
PRIOR ART FIG. 26
FIG. 26 is an enlarged development of the cam profile of the conventional sorting apparatus.

FIG. 23 is an overall view of the post-image formation sheet processing apparatus in accordance with the present invention. As evident from FIG. 23, an automatic original feeding apparatus 300, which automatically circulates the original, is disposed on the top surface of an image forming apparatus 200. On the downstream side of the original feeding apparatus 300, a sorting apparatus (hereinafter, sorter) 1 is disposed, which comprises n pieces of bin trays B (B1, B2 . . . Bn).

The image forming apparatus 200 employs a well-known electro-photographic system, the detailed description of which will be omitted here. In this apparatus 200, the original positioned on the platen glass 208 is projected onto a photosensitive drum 201 by an optical system, forming a latent image. The latent image is developed and transferred onto a sheet material by a developing apparatus 202 and a transfer electrode 203, which are disposed around the photosensitive drum 201, and is permanently fixed by a fixing device 205.

In the main assembly of the sorter 1, a sheet conveying section 50 is formed, which has an entrance opening through which a sheet S discharged from a discharge roller pair 206 of an image forming apparatus such as a copying machine. It comprises a first sheet path leading from the entrance to the aforementioned bin unit, and a second sheet path which branches from the first sheet path. On the downstream sides of the first and second sheet paths, a top discharge roller pair for discharging the non-sort sheets (sheets not to be sorted), and a bottom discharge roller pair for discharging the sort sheets (sheets to be sorted), are disposed, respectively.

At the branching portions of these first and second sheet paths, a take in roller pair and a deflector are disposed. When the non-sort mode (mode for not sorting the sheets) is selected, the deflector orientation is changed to guide the sheet S into the first sheet path, and when the sort mode (mode for sorting the sheets) is selected, it is changed to guide the sheet S into the second sheet path.

While the invention has been described with reference to the structures disclosed herein, it is not confined to the details set forth, and this application is intended to cover such modifications or changes as may come within the purposes of the improvements or the scope of the following claims.

What is claimed is:

1. A sheet sorting apparatus, comprising:

a plurality of trays for accommodating sheets;

helical cam means, engageable with a cam follower for moving said plurality of trays;

cam driving means for driving said helical cam means;

sheet set processing means movable between a processing position and a retracted position where said processing means does not interfere with said plurality of trays;

driving means for advancing or retracting said sheet set processing means; and controlling means for controlling said cam driving means and said driving means;

wherein a cam surface of said helical cam is constituted of substantially horizontal portions and slanted portions; and said cam driving means and said driving means being controlled by said controlling means, in such a manner that said sheet set processing means starts to enter a processing position when said cam follower shifts from the slanted portions to the horizontal portions, and the entering operation ends by the time said cam follower reaches a middle portion of the horizontal portions, and that said cam driving means is deactivated when the cam follower is substantially at a middle portion of the horizontal portions, and after sheet set processing, said cam driving means and said driving means are actuated, and the sheet processing means is retracted from a moving path region of the tray by the time said cam follower passes through the remaining portion of the horizontal portions.

2. A sheet sorting apparatus according to claim 1, wherein said plurality of trays are vertically movable; and stapling means, of said sheet set processing means, is advanced to, or retracted from, the sheet set in said tray, in a reciprocating manner.

3. A sheet sorting apparatus according to claim 1, wherein the sheet set processing timing is matched with the horizontal portion, and said cam driving means is stopped during the sheet processing.

4. A sheet sorting apparatus according to claim 1, wherein when the sheet set in the first bin is processed, said processing means is advanced without activating said cam driving means, and then, after processing, said cam driving means as well as said driving means are activated.

5. A sheet sorting apparatus according to claim 1, wherein said cam driving means and said driving means comprise a pulse controlled shift motor and a pulse controlled driving motor, respectively, and are independently controllable, said shift motor being allowed to continue its rotation after said processing means arrives at the retracting position, whereas said shift motor being deactivated.

6. A sheet sorting apparatus according to claim 1, wherein said cam driving means and said driving means comprise a pulse controlled shift motor and a pulse controlled driving motor, respectively, and said apparatus further comprises a synchronization clock controlling means, which can be switched so that said driving motor is rotated in synchronism with said shift motor.

7. A sheet sorting apparatus according to claim 6, wherein said driving motor is rotated alone before the sheet set in the first bin is processed, and after the sheet set in the last bin is processed; and both motors are synchronously rotated during other periods.

8. A sheet sorting apparatus according to claim 1, wherein the horizontal portions of the cam surface is equivalent to 180° of the cam angle, and said cam driving means is deactivated when the cam follower is substantially at the middle of the horizontal portion.

9. An apparatus according to claim 5, wherein said driving means is driven when the cam follower is at a horizontal portion to retract the sheet set processing means.

10. An apparatus according to claim 6, wherein said driving means is driven in synchronism with said cam driving means to retract said sheet set processing means when the cam follower is at a horizontal portion and when the cam follower is at a slanted portion.

11. A sheet sorting apparatus, according to claim 1 that said sheet set processing means stop to move to, or from, said tray, within a time duration in which said cam driving means is operated, and said cam follower is being engaged with the slanted portions of said cam means.

12. A sheet sorting apparatus according to claim 1, wherein said processing means continues to move to, or from, said tray, within a time duration in which said cam driving means is operated, and said cam follower is being engaged with the slanted portions of said cam means.

13. An image forming apparatus, comprising:

image forming means; and a sheet sorting means, comprising:

a plurality of trays for accommodating sheets;

helical cam means, engageable with a cam follower for moving said plurality of trays;

cam driving means for driving said helical cam means;

sheet set processing means movable between a processing position and a retracted position where said processing means does not interfere with said plurality of trays;

driving means for advancing or retracting said sheet set processing means; and controlling means for controlling said cam driving means and said driving means;

wherein a cam surface of said helical cam is constituted of substantially horizontal portions and slanted portions; and said cam driving means and said driving means being controlled by said controlling means, in such a manner that said sheet set processing means starts to enter a processing position when said cam follower shifts from the slanted portions to the horizontal portions, and the entering operation ends by the time said cam follower reaches a middle portion of the horizontal portions, and that said cam driving means is deactivated when the cam follower is substantially at a middle portion of the horizontal portions, and after sheet set processing, said cam driving means and said driving means is actuated, and the sheet processing means is retracted from a moving path region of the tray by the time said cam follower passes through the remaining portion of the horizontal portions.

14. An image forming apparatus according to claim 13, wherein said plurality of trays are vertically movable; and stapling means, of said sheet set processing means, is advanced to, or retracted from, the sheet set in said tray, in a reciprocating manner.

15. An image forming apparatus according to claim 13, wherein when the sheet set in the first bin is processed, said sheet set processing means is advanced without activating said cam driving means, and then, after processing, said cam driving means as well as said driving means are activated.

16. An image forming apparatus according to claim 13, wherein said cam driving means and said driving means comprise a pulse controlled shift motor and a pulse controlled driving motor, respectively, and are independently controllable, said shift motor being allowed to continue its rotation after sheet set processing means arrives at the retracting position, whereas said driving motor being deactivated.

17. An image forming apparatus according to claim 13, wherein said cam driving means and said driving means comprise a pulse controlled shift motor and a pulse controlled driving motor, respectively, and said apparatus further comprises a synchronization clock controlling means, which can be switched so that said driving motor is rotated in synchronism with said shift motor.

18. An image forming apparatus according to claim 17, wherein said driving motor is rotated alone before the sheet set in the first bin is processed, and after the sheet set in the last bin is processed; and both motors are synchronously rotated during other periods.

19. An image forming apparatus according to claim 13, wherein the horizontal portions of the cam surface is equivalent to 180× of the cam angle, and said cam driving means is deactivated when the cam follower is substantially at the middle of the horizontal portion.

20. An image forming apparatus according to claim 13, wherein said processing means stop to move to, or from, said tray, within a time duration in which said cam driving means is operated, and said cam follower is being engaged with the slanted portions of said cam means.

21. An image forming apparatus according to claim 13, wherein said sheet set processing means continues to move to, or from, said tray, within a time duration in which said cam driving means is operated, and said cam follower is being engaged with the slanted portions of said cam means.

22. A sheet sorting apparatus, comprising:

a plurality of trays for accommodating sheets;

helical cam means, engageable with a cam follower for moving said plurality of trays;

cam driving means for driving said helical cam means;

sheet set processing means movable between a processing position and a retracted position where said processing means does not interfere with said plurality of trays;

driving means for advancing or retracting said sheet set processing means; and controlling means for controlling said cam driving means and said driving means;

wherein a cam surface of said helical cam is constituted of substantially horizontal portions and slanted portions; and said cam driving means and said driving means being controlled by said controlling means, in such a manner that said processing means is advanced to, or retracted from, said tray, within a time duration in which said cam driving means is operated, and said cam follower is being engaged with the horizontal portions of said cam means, and that said processing means continues to move to, or from, said tray, within a time duration in which said cam driving means is operated, and said cam follower is being engaged with the slanted portions of said cam means.

23. A sheet sorting apparatus according to claim 22, wherein said plurality of trays are vertically movable; and stapling means, of said sheet set processing means, is advanced to, or retracted from, the sheet set in said tray, in a reciprocating manner.

24. A sheet sorting apparatus according to claim 22, wherein the sheet set processing timing corresponds with the engagement of said horizontal portions, and said cam driving means is stopped during the sheet processing.

25. A sheet sorting apparatus according to claim 22, wherein said cam driving means and said driving means comprise a pulse controlled shift motor and a pulse controlled driving motor, respectively, and are independently controllable.

26. A sheet sorting apparatus according to claim 22, wherein said cam driving means and said driving means comprise a pulse controlled shift motor and a pulse controlled driving motor, respectively, and said apparatus further comprises a synchronization clock controlling means, which can be switched so that said driving motor is rotated in synchronism with said shift motor.

27. A sheet sorting apparatus according to claim 22, wherein the horizontal portion of the cam surface is equivalent to 180° of the cam angle, and said cam driving means is deactivated when the cam follower is substantially at a middle portion of the horizontal portion.

28. A sheet sorting apparatus according to claim 22, wherein said cam driving means is deactivated when the cam follower is substantially at a middle portion of the horizontal portion, and after the sheet processing, said cam driving means and said driving means are actuated, and the sheet processing means is retracted from a moving path region of the tray by the time said cam follower passes through a remaining portion of the horizontal portion.

29. A sheet sorting apparatus according to claim 28, wherein when said sheet set processing means starts to enter a processing position when said cam follower shifts from the slanted portions to the horizontal portions, and the entering operation ends by the time said cam follower reaches the middle portion.

30. An image forming apparatus comprising:

image forming means; and a sheet sorting means, comprising:

a plurality of trays for accommodating sheets;

helical cam means, engageable with a cam follower for moving said plurality of trays;

cam driving means for driving said helical cam means;

sheet set processing means movable between a processing position and a retracted position where said processing means does not interfere with said plurality of trays;

driving means for advancing or retracting said sheet set processing means; and controlling means for controlling said cam driving means and said driving means;

wherein a cam surface of said helical cam is constituted of substantially horizontal portions and slanted portions; and said cam driving means and said driving means being controlled by said controlling means, in such a manner that said processing means is advanced to, or retracted from, said tray, within a time duration in which said cam driving means is operated, and said cam follower is being engaged with the horizontal portions of said cam means, and that said processing means continues to move to, or from, said tray, within a time duration in which said cam driving means is operated, and said cam follower is being engaged with the slanted portions of said cam means.

31. An image forming apparatus according to claim 30, wherein said plurality of trays are vertically movable; and stapling means, of said sheet set processing means, is advanced to, or retracted from, the sheet set in said tray, in a reciprocating manner.

32. An image forming apparatus according to claim 30, wherein the sheet set processing timing corresponds with the engagement of the horizontal portions, and said cam driving means is stopped during the sheet processing.

33. An image forming apparatus according to claim 32, wherein the horizontal portion of the cam surface is equivalent to 180° of the cam angle, and said cam driving means is deactivated when the cam follower is substantially at a middle portion of the horizontal portion.

34. An image forming apparatus according to claim 30, wherein said cam driving means and driving means comprise a pulse controlled shift motor and a pulse controlled driving motor, respectively, and are independently controllable.

35. An image forming apparatus according to claim 30, wherein said cam driving means and driving means comprise a pulse controlled shift motor and a pulse controlled driving motor, respectively, and said apparatus further comprises a synchronization clock controlling means, which can be switched so that said driving motor is rotated in synchronism with said shift motor.

* * * * *